US011257446B2

(12) United States Patent
Yamaguchi et al.

(10) Patent No.: US 11,257,446 B2
(45) Date of Patent: Feb. 22, 2022

(54) LIQUID CRYSTAL DISPLAY DEVICE

(71) Applicant: Sharp Kabushiki Kaisha, Sakai (JP)

(72) Inventors: Takahiro Yamaguchi, Sakai (JP); Shuji Nishi, Sakai (JP); Shige Furuta, Sakai (JP); Hiroyuki Adachi, Sakai (JP); Nami Nagira, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/984,191

(22) Filed: Aug. 4, 2020

(65) Prior Publication Data

US 2021/0043152 A1 Feb. 11, 2021

Related U.S. Application Data

(60) Provisional application No. 62/884,687, filed on Aug. 9, 2019.

(51) Int. Cl.
*G09G 3/36* (2006.01)

(52) U.S. Cl.
CPC ..... *G09G 3/36* (2013.01); *G09G 2370/045* (2013.01)

(58) Field of Classification Search
None
See application file for complete search history.

(56) References Cited

U.S. PATENT DOCUMENTS

2004/0012580 A1* 1/2004 Yamagishi ..... G09G 3/3688 345/204
2010/0295841 A1 11/2010 Matsuda et al.
2010/0309173 A1* 12/2010 Matsuda ..... G09G 3/3674 345/204
2014/0168042 A1 6/2014 Choi et al.
2018/0373078 A1 12/2018 Mizuno
2020/0168175 A1* 5/2020 Tsuchi ..... G09G 3/2096

FOREIGN PATENT DOCUMENTS

CN 103871381 A 6/2014
JP 2010-233002 A 10/2010
JP 2012-194582 A 10/2012
JP 2017-116661 A 6/2017

* cited by examiner

*Primary Examiner* — Yanna Wu
(74) *Attorney, Agent, or Firm* — Keating & Bennett, LLP

(57) ABSTRACT

A plurality of pieces of serial data are supplied to a liquid crystal display device from an outside. An SI signal selection circuit switches processing target data to be captured between one piece of serial data included in the plurality of pieces of serial data and the plurality of pieces of serial data in accordance with a serial data selection signal. The processing target data captured by the SI signal selection circuit is converted into parallel data by a data conversion circuit. In accordance with one clock pulse of a serial clock, serial-parallel conversion processing is performed in parallel on a plurality pieces of serial data.

10 Claims, 34 Drawing Sheets

| SB | R | Q |
|---|---|---|
| H | L | HOLD |
| H | H | L |
| L | L | H |
| L | H | L |

LIQUID CRYSTAL DISPLAY DEVICE

BACKGROUND

1. Field

The following disclosure relates to a liquid crystal display device, and more particularly to a liquid crystal display device configured such that a memory circuit is provided in a pixel circuit.

2. Description of the Related Art

In recent years, in order to reduce power consumption, a liquid crystal display device configured such that a memory circuit is provided in a pixel circuit has been developed. Such a liquid crystal display device is called a "memory liquid crystal display" or the like. In memory liquid crystal displays, generally, 1-bit data can be held in each pixel. When the same or similar content continues in a displayed image for a long period of time, data held in the memory circuits are used in displaying the image. In the memory liquid crystal display, once data is written in a memory circuit, the content of the data written in the memory circuit is held until the data is rewritten. Therefore, almost no power is consumed except for a period around an occurrence of a change in content of the image. Therefore, the memory liquid crystal display allows a reduction in the power consumption.

An example of such a memory liquid crystal display is disclosed in Japanese Unexamined Patent Application Publication No. 2012-194582. In the memory liquid crystal display disclosed in Japanese Unexamined Patent Application Publication No. 2012-194582, serial data including image data is supplied from the outside of a panel via serial transmission. A flag is added to the serial data, and various timing signals are generated in a timing generator based on the flag, a serial clock, and a serial chip select signal.

According to the memory liquid crystal display disclosed in Japanese Unexamined Patent Application Publication No. 2012-194582, a remarkably small number of signal lines are used to receive data from the outside. This provides effects such as a reduction in a device size or the like. However, since only one serial data line for transmitting serial data is provided, only one piece of data can be processed in one clock (one clock pulse of the serial clock). Therefore, when the number of pixels provided in the display unit increases, there is a possibility that a screen rewriting frequency is not sufficiently high. In this regard, for example, in a case where the specifications indicate that the clock frequency is 1 MHz and the screen rewriting frequency is 30 Hz, the maximum allowable number of pixels that can be set is "240×137". In this case, if the number of pixels provided in the display unit is greater than "240×137", the screen rewriting frequency is lower than a specified value.

Japanese Unexamined Patent Application Publication No. 2017-116661 discloses a configuration of a memory liquid crystal display in which a serial interface such as MIPI or the like is used. Furthermore, in relation to the following disclosure, Japanese Unexamined Patent Application Publication No. 2010-233002 discloses a communication device in which a plurality of ports are provided and the number of ports used is changed depending on a data transfer rate.

However, in the communication device disclosed in Japanese Unexamined Patent Application Publication No. 2010-233002, serial data is converted into parallel data and the resultant parallel data is transmitted in which the number of ports used is changed as appropriate when the parallel data is transmitted. Therefore, even if the configuration of this communication device is applied to the memory liquid crystal display disclosed in Japanese Unexamined Patent Application Publication No. 2012-194582 or Japanese Unexamined Patent Application Publication No. 2017-116661, no increase occurs in the number of pieces of serial data that can be handled in one clock.

Thus, it is desirable to increase the maximum number of pixels which can satisfy the specification in terms of the screen rewriting frequency in the liquid crystal display device.

SUMMARY

According to an aspect of the disclosure, there is provided a liquid crystal display device including a plurality of pixel circuits each including a memory circuit, the liquid crystal display device including an interface unit for receiving a plurality of pieces of serial data corresponding to image data and a serial clock signal from an outside, a serial data selection circuit configured to switch processing target data to be captured between one piece of serial data included in the plurality of pieces of serial data and the plurality of pieces of serial data in accordance with a serial data selection signal, a serial data conversion circuit configured to perform a serial-parallel conversion process for converting the processing target data captured by the serial data selection circuit into parallel data, and a display drive circuit configured to update data in the memory circuit disposed in each of the plurality of pixel circuits according to the parallel data obtained via the serial-parallel conversion process, wherein the serial data conversion circuit is capable of performing the serial-parallel conversion process on the plurality of pieces of serial data in parallel in accordance with one clock pulse of the serial clock signal.

According to an aspect of the disclosure, there is provided a liquid crystal display device including a plurality of pixel circuits each including a memory circuit, the liquid crystal display device including an interface unit for receiving a plurality of pieces of serial data corresponding to image data and a serial clock signal from an outside, a serial data conversion circuit configured to perform a serial-parallel conversion process to convert the plurality of pieces of serial data into parallel data, and a display drive circuit configured to update data in the memory circuit disposed in each of the plurality of pixel circuits according to the parallel data obtained via the serial-parallel conversion process, wherein the serial data conversion circuit performs the serial-parallel conversion process on the plurality of pieces of serial data in parallel in accordance with one clock pulse of the serial clock signal.

DESCRIPTION OF THE EMBODIMENTS

Embodiments are described below with reference to accompanying drawings. Liquid crystal display devices described below with reference to respective following embodiments each are of a type called the "memory liquid crystal display" described above. A large number of control signals are used in the liquid crystal display device, and, in the following description, these control signals are denoted by reference symbols to distinguish from each other. Furthermore, a plurality of constituent elements which are similar in function to each other are also denoted by reference symbols to distinguish from each other. In the following description, it is assumed that a high level of each signal corresponds to a logical value "1" and a low level corresponds to a logical value "0".

1. First Embodiment

1.1 Overall Configuration and Brief Description of Operation

Figure 2:
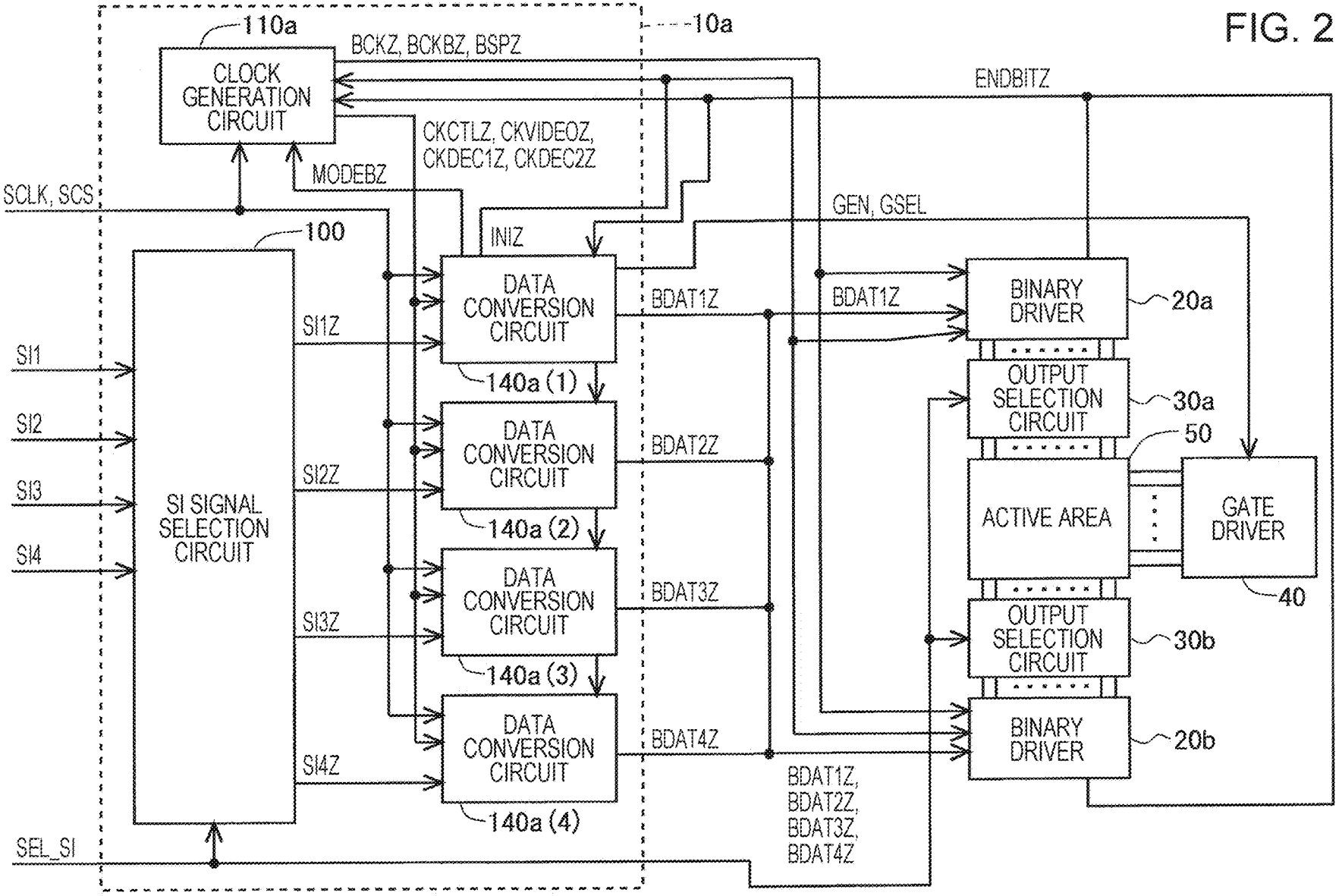
FIG. 2 is a block diagram illustrating an overall configuration of a liquid crystal display device according to the first embodiment.

FIG. 2 is a block diagram illustrating an overall configuration of a liquid crystal display device according to a first embodiment. As shown in FIG. 2, this liquid crystal display device includes a timing generator 10*a*, two binary drivers 20*a* and 20*b*, two output selection circuits 30*a* and 30*b*, a gate driver 40, and an active area 50. The timing generator 10*a* includes an SI signal selection circuit 100, a clock generation circuit 110*a*, and four data conversion circuits 140*a*(1) to 140*a*(4).

Figure 1:
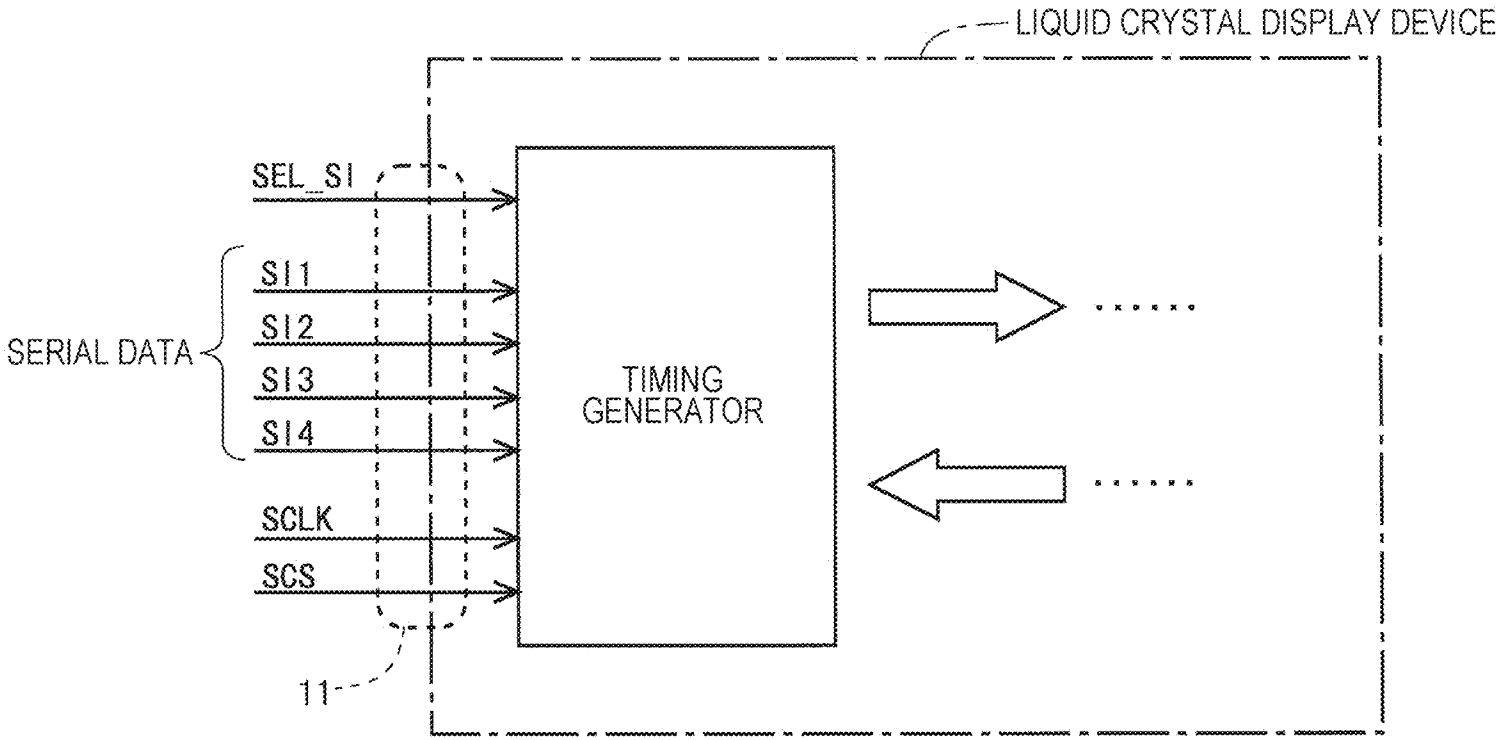
FIG. 1 is a diagram for explaining that four serial data lines are provided in a first embodiment.

Regarding signals supplied to the liquid crystal display device, serial data SI1 to SI4, a serial data selection signal SEL_SI, a serial clock SCLK, and a serial chip select signal SCS are supplied to a timing generator via an interface unit 11, as shown in FIG. 1. In the configuration disclosed in Japanese Unexamined Patent Application Publication No. 2012-194582 described above, only one serial data line for transmitting serial data is provided. In contrast, in the present embodiment, four serial data lines are provided. Note that by using the serial data selection signal SEL_SI, it is possible to select (switch) whether one serial data line is used or four serial data lines are used.

A general operation of each constituent element shown in FIG. 2 is described below. The timing generator 10*a* receives the serial data SI1 to SI4, the serial data selection signal SEL_SI, the serial clock SCLK, the serial chip select signal SCS, and a control signal ENDBITZ, and outputs a gate enable signal GEN, a gate selection signal GSEL, a control signal BCKZ, a control signal BCKBZ, a control signal BSPZ, a control signal INIZ, binary data BDAT1Z to BDAT4Z, and a serial data selection signal SEL_SI. The gate enable signal GEN includes four pieces of 1-bit data, the gate selection signal GSEL includes twelve pieces of 1-bit data, and the binary data BDAT1Z to BDAT4Z each include eight pieces of 1-bit data.

The SI signal selection circuit 100 in the timing generator 10*a* receives the serial data SI1 to SI4 and the serial data selection signal SEL_SI, and outputs serial data SI1Z to SI4Z according to the serial data selection signal SEL_SI.

The clock generation circuit 110*a* in the timing generator 10*a* receives the serial clock SCLK, the control signal MODEBZ, the control signal ENDBITZ, and the control signal INIZ, and outputs a control signal BCKZ, a control signal BCKBZ, a control signal BSPZ, a control signal CKCTLZ, a control signal CKVIDEOZ, a control signal CKDEC1Z and a control signal CKDEC2Z.

The data conversion circuit 140*a*(1) in the timing generator 10*a* receives the serial clock SCLK, the serial chip select signal SCS, serial data SI1Z, a control signal CKCTLZ, a control signal CKVIDEOZ, a control signal CKDEC1Z, a control signal CKDEC2Z, and the control signal ENDBITZ, and outputs the control signal INIZ, a control signal MODEBZ, the gate enable signal GEN, the selection signal GSEL, and binary data BDAT1Z.

The data conversion circuit 140*a*(2) in the timing generator 10*a* receives the serial clock SCLK, the serial chip select signal SCS, the serial data SI2Z, the control signal CKCTLZ, the control signal CKVIDEOZ, the control signal CKDEC1Z, the control signal CKDEC2Z, and the control signal ENDBITZ, and outputs binary data BDAT2Z. The data conversion circuit 140*a*(3) and the data conversion circuit 140*a*(4) are similar to the data conversion circuit 140*a*(2).

The binary driver 20*a* receives the control signal BCKZ, the control signal BCKBZ, the control signal BSPZ, the control signal INIZ, and the binary data BDAT1Z, and outputs a data signal (not shown in FIG. 2) and the control signal ENDBITZ. The binary driver 20*b* receives the control signal BCKZ, the control signal BCKBZ, the control signal BSPZ, the control signal INIZ, and the binary data BDAT1Z to BDAT4Z, and outputs a data signal (not shown in FIG. 2) and the control signal ENDBITZ. The data signal output from the binary driver 20*a* is given to the output selection circuit 30*a*, and the data signal output from the binary driver 20*b* is given to the output selection circuit 30*b*.

According to the serial data selection signal SEL_SI, the output selection circuit 30*a* switches between a state in which the data signal output from the binary driver 20*a* is supplied to the active area 50 and a state in which the binary driver 20*a* and the active area 50 are electrically disconnected from each other. In other words, the output selection circuit 30*a* controls, according to the serial data selection signal SEL_SI, whether or not the data signal output from the binary driver 20*a* is to be supplied to the memory circuit described later. According to the serial data selection signal SEL_SI, the output selection circuit 30*b* switches between a state in which the data signal output from the binary driver 20*b* is supplied to the active area 50 and a state in which the binary driver 20*b* and the active area 50 are electrically disconnected from each other. In other words, the output selection circuit 30*b* controls, according to the serial data selection signal SEL_SI, whether or not the data signal output from the binary driver 20*b* is to be supplied to the memory circuit described later.

The gate driver 40 receives the gate enable signal GEN and the gate selection signal GSEL and drives scanning signal lines (a plurality of first scanning signal lines and a plurality of second scanning signal lines) provided in the active area 50.

In the active area 50, a plurality of data signal lines, the plurality of first scanning signal lines, and the plurality of second scanning signal lines are formed. Furthermore, in the active area 50, a plurality of pixel circuits are arranged in the form of a matrix. That is, in the active area 50, a pixel matrix having a plurality of rows and a plurality of columns is formed. In the following description, it is assumed that the number of data signal lines is 400, and the number of first scanning signal lines and the number of second scanning signal lines are each 240. When data signals are supplied to respective data signal lines and the plurality of first scanning signal lines are sequentially selected, writing (writing of data signals) to the plurality of pixel circuits is performed. As a result, a particular image is displayed in the active area 50. Thus, the active area 50 functions as a display unit that displays the image. As the shape of the active area 50, a non-rectangular shape such as a circle may be adopted.

In the present embodiment, the serial data selection circuit is implemented by the SI signal selection circuit 100, the serial data conversion circuit is implemented by the data conversion circuits 140*a*(1) to 140*a*(4), and the display drive circuit is implemented by the binary drivers 20*a* and 20*b*, the output selection circuits 30*a* and 30*b* and the gate driver 40. Furthermore, the first data drive circuit is implemented by the binary driver 20*a*, the first output control circuit is implemented by the output selection circuit 30*a*, the second data drive circuit is implemented by the binary driver 20*b*, and the second output control circuit is implemented by the output selection circuit 30*b*.

1.2 Pixel Circuit

Figure 3:
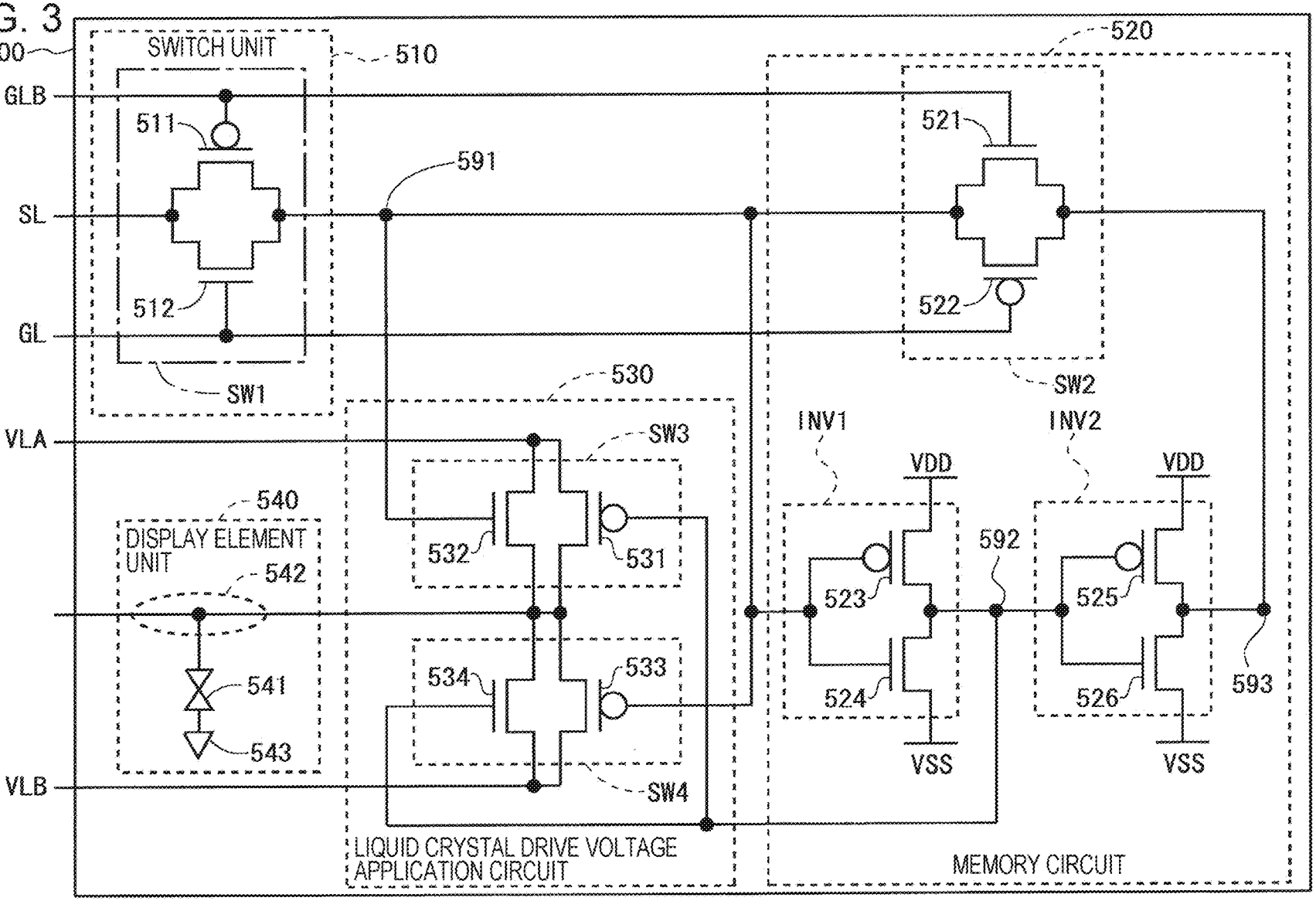
FIG. 3 is a circuit diagram illustrating a detailed configuration of one pixel circuit in an active area according to the first embodiment.

FIG. 3 is a circuit diagram showing a detailed configuration of one pixel circuit 500 in the active area 50. Note that the configuration shown in FIG. 3 is merely an example, and the configuration is not limited to this example. As shown in FIG. 3, the pixel circuit 500 according to the present embodiment includes a switch unit 510, a memory circuit 520, a liquid crystal drive voltage application circuit 530, and a display element unit 540. The pixel circuit 500 receives a scan signal GL via the above-described first scan signal line, a scan signal GLB via the above-described second scan signal line, and a data signal SL via the above-described data signal line. Furthermore, the pixel circuit 500 receives a white display voltage VLA and a black display voltage VLB via two power lines.

The switch unit 510 includes a first switch SW1 which is a CMOS switch including a p-channel type transistor 511 and an n-channel type transistor 512. The first switch SW1 turns on when the scanning signal GL is at the high level and the scanning signal GLB is at the low level. When the first switch SW1 is in the ON state, the data signal line, which transmits the data signal SL, is electrically connected to a node 591. In the above operations, when the scanning signal GL goes to the high level and the scanning signal GLB goes to the low level, the first switch SW1 turns on, and the potential of the data signal SL is given to the node 591.

The memory circuit 520 includes a second switch SW2 that is a CMOS switch including an n-channel transistor 521 and a p-channel transistor 522, and a first inverter INV1 that is a CMOS inverter including a p-channel transistor 523 and an n-channel transistor 524, and furthermore a second inverter INV2 that is a CMOS inverter including a p-channel type transistor 525 and an n-channel type transistor 526. The second switch SW2 turns on when the scanning signal GLB is at the high level and the scanning signal GL is at the low level. When the second switch SW2 is in the ON state, a node 591 and a node 593 are electrically connected to each other. Regarding the first inverter INV1, its input terminal is connected to the node 591 and its output terminal is connected to a node 592. Regarding the second inverter INV2, its input terminal is connected to the node 592 and its output terminal is connected to the node 593. Thus, the memory circuit 520 functions such that a value (a logical value) corresponding to a potential given to the node 591 when the first switch SW1 is in the ON state is held until the first switch SW1 turns on for the next time.

The liquid crystal drive voltage application circuit 530 includes a third switch SW3 which is a CMOS switch including a p-channel type transistor 531 and an re-channel type transistor 532, and a fourth switch SW4 which is a CMOS switch including a p-channel type transistor 533 and an n-channel type transistor 534. The third switch SW3 turns on when the potential of the node 591 is at the high level and the potential of the node 592 is at the low level. When the third switch SW3 is in the on state, the white display voltage VLA is applied to the pixel electrode 542. The fourth switch SW4 turns on when the potential of the node 591 is at the low level and the potential of the node 592 is at the high level. When the fourth switch SW4 is in the on state, a black display voltage VLB is applied to the pixel electrode 542.

The display element unit 540 includes a liquid crystal 541, the pixel electrode 542, and a common electrode 543. A voltage is applied to the liquid crystal according to the voltage applied to the pixel electrode 542 and the voltage applied to the common electrode 543. As a result, the voltage applied to the liquid crystal is reflected in the display state of the pixel.

In the pixel circuit 500 configured as described above, binary data is stored in the memory circuit 520 according to the potential of the data signal when the first switch SW1 is in the ON state. In the liquid crystal drive voltage application circuit 530, the display voltage (either the white display voltage VLA or the black display voltage VLB) to be applied to the pixel electrode 542 is selected according to the binary data stored in the memory circuit 520. In accordance with the display voltage applied to the pixel electrode 542 and a voltage (a common voltage) applied to the common electrode 543, the pixel display state goes to the white display state or the black display state.

In the present embodiment, updating of the data in the memory circuit 520 included in the pixel circuit 500 is performed by the binary drivers 20*a* and 20*b* and the output selection circuits 30*a* and 30*b* and furthermore the gate driver 40 according to the parallel data obtained as a result of the serial-parallel conversion process described later the.

1.3 Detailed Configuration and Operation of Each Component

Figure 4:
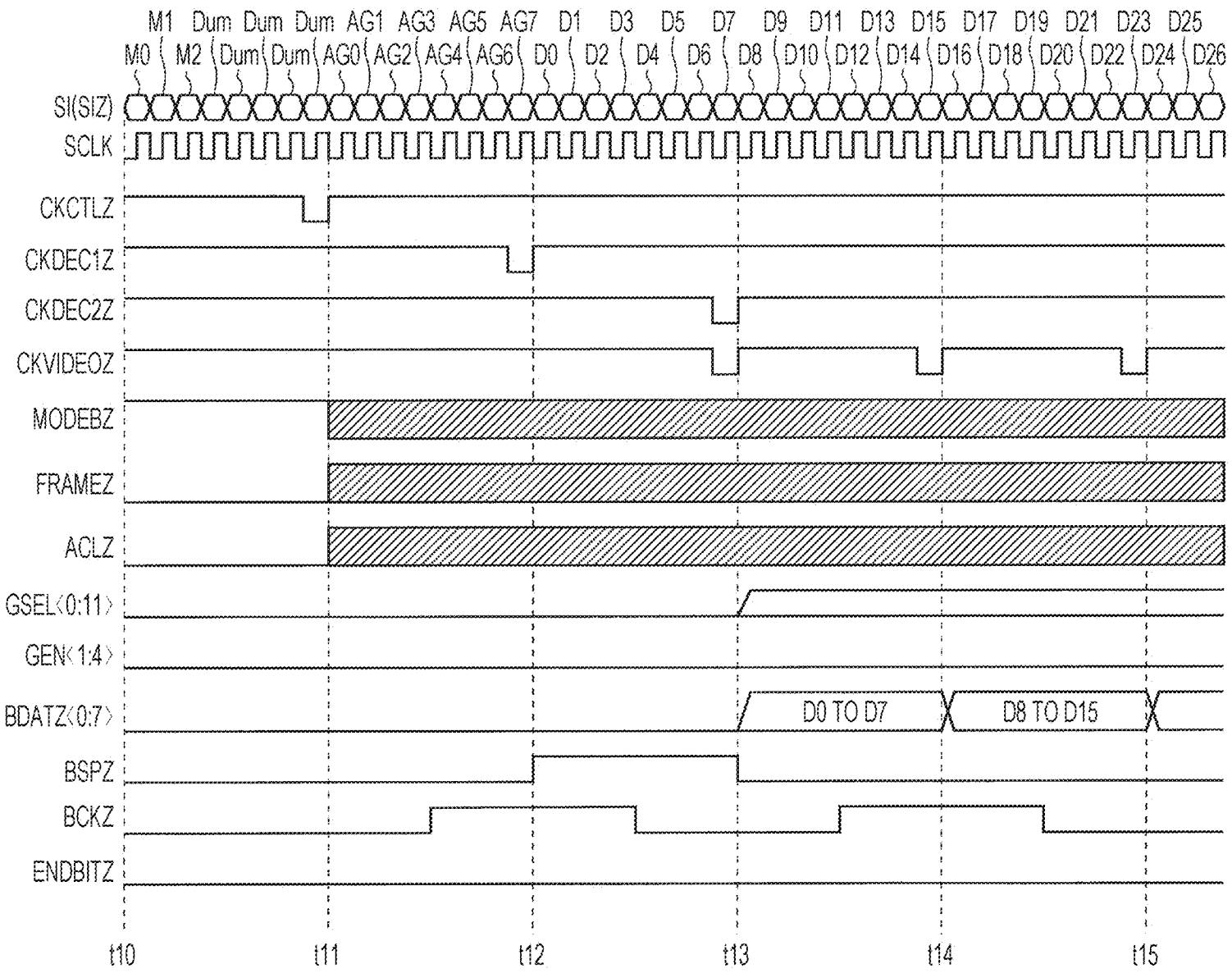
FIG. 4 is a signal waveform diagram (a signal waveform diagram around the start of a frame period) according to the first embodiment.
Figure 5:
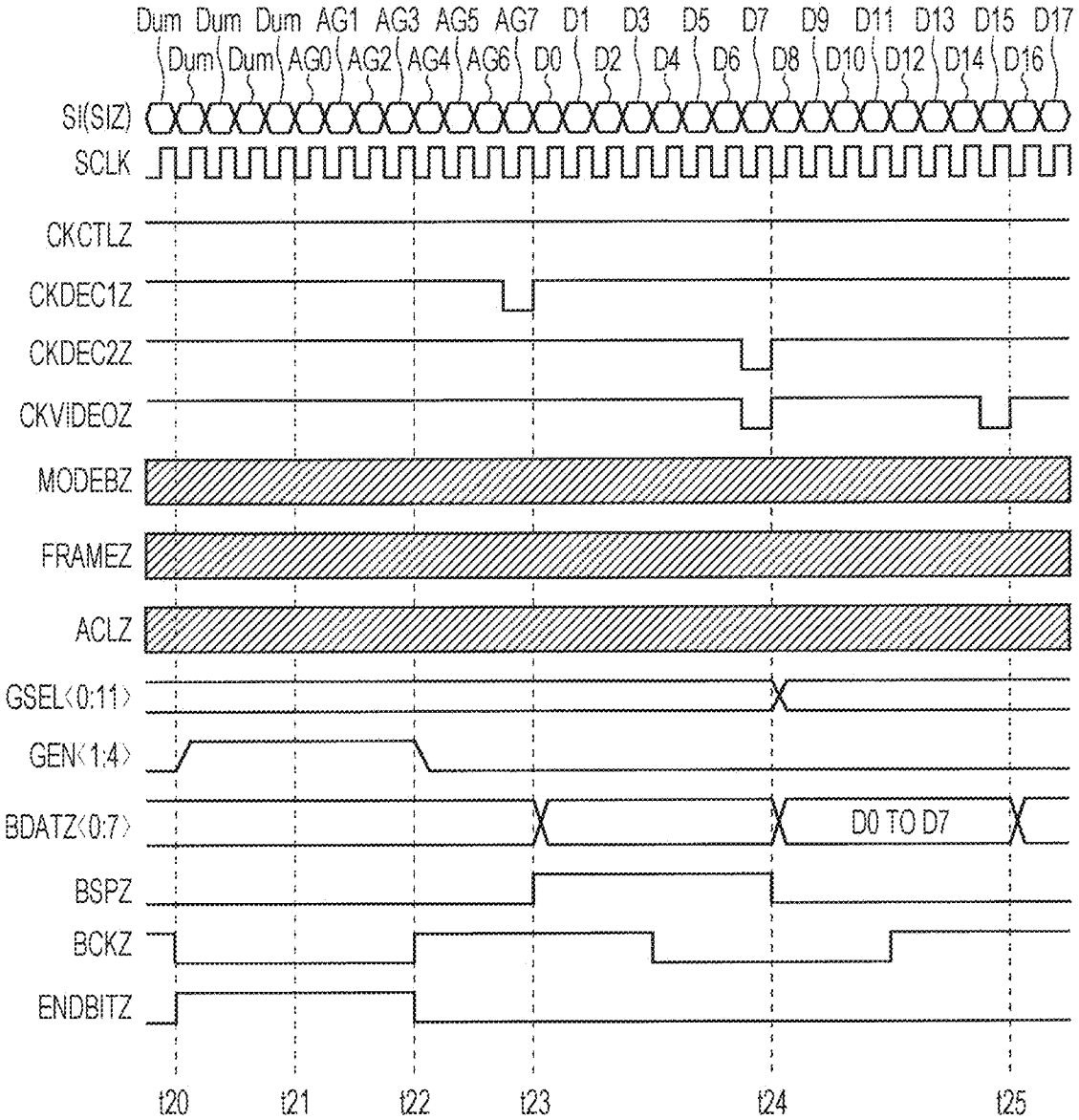
FIG. 5 is a signal waveform diagram (a signal waveform diagram around the start of a horizontal scanning period corresponding to a row other than the first row) according to the first embodiment.

The detailed configuration and operation of each of the constituent elements shown in FIG. 2 are described below. In the following description, signal waveform diagrams shown in FIGS. 4 and 5 are referred to, as appropriate. Note that the four serial data SI1 to SI4 are generically referred to as serial data SI, while the four serial data SI1Z to SI4Z are generically referred to as serial data SIZ.

FIG. 4 is a signal waveform diagram around the start of a frame period (around the start of a horizontal scanning period corresponding to a first row). FIG. 5 is a signal waveform diagram showing signal waveforms around the start of a horizontal scanning period for a row other than the first row. Although the serial data SI mainly includes image data, the serial data SI also includes flag data for operation control and gate address data for selectively driving the scanning signal lines (and further including dummy data). In FIG. 4 and FIG. 5, flag data is denoted by a symbol beginning with "M", gate address data is denoted by a symbol beginning with "AG", image data is denoted by a symbol beginning with "D" (except for "Dum"), and dummy data is denoted by "Dum". The flag data M0 to M2 appear every frame period. The gate address data AG0 to AG7 appear every horizontal scanning period.

The flag data M0 is data for controlling the operation of the timing generator 10*a*. In the normal operation, the flag data M0 is set to the high level. However, for example, to stop the operation of binary drivers 20*a* and 20*b*, the flag data M0 is set to the low level. The flag data M1 is data for setting the potential of the common electrode 543 (see FIG. 3). In order to AC-drive the liquid crystal 541, the potential of the common electrode 543 is alternately set to a relatively high potential and a relatively low potential every frame period. That is, the potential of the common electrode 543 in each frame period is determined according to the flag data M1. The flag data M2 is data for initializing the memory circuits 520 in all pixel circuits 500 (see FIG. 3). In the normal operation, the flag data M2 is set to the low level. However, when the initialization of the memory circuit 520 is executed, the flag data M2 is set to the high level. The gate address data AG0 to AG7 appearing every horizontal scanning period is set to values (levels) so as to identify a row to which the data signal is to be written in a particular horizontal scanning period. That is, one row is identified by a combination of eight pieces of gate address data AG0 to AG7.

The serial clock SCLK is a synchronization clock signal for capturing 1-bit data of the serial data SI. As can be seen from FIG. 4 and FIG. 5, the serial clock SCLK changes from the low level to the high level when a predetermined period elapses since the start of transmission of each 1-bit data of the serial data SI. Note that the serial chip select signal SCS (not shown in FIG. 4 and FIG. 5) changes from the low level to the high level at a time point before the start of transmission of flag data in each frame period, and changes from the high level to the low level at a time point after the end of the transmission of image data.

1.3.1 Timing Generator

Constituent elements included in the timing generator 10*a* are described below. In the present embodiment, it is assumed that one serial data line is used when the serial data selection signal SEL_SI is at the high level, while four serial data lines are used when the serial data selection signal SEL_SI is at the low level.

1.3.1.1 SI Signal Selection Circuit

Figure 6:
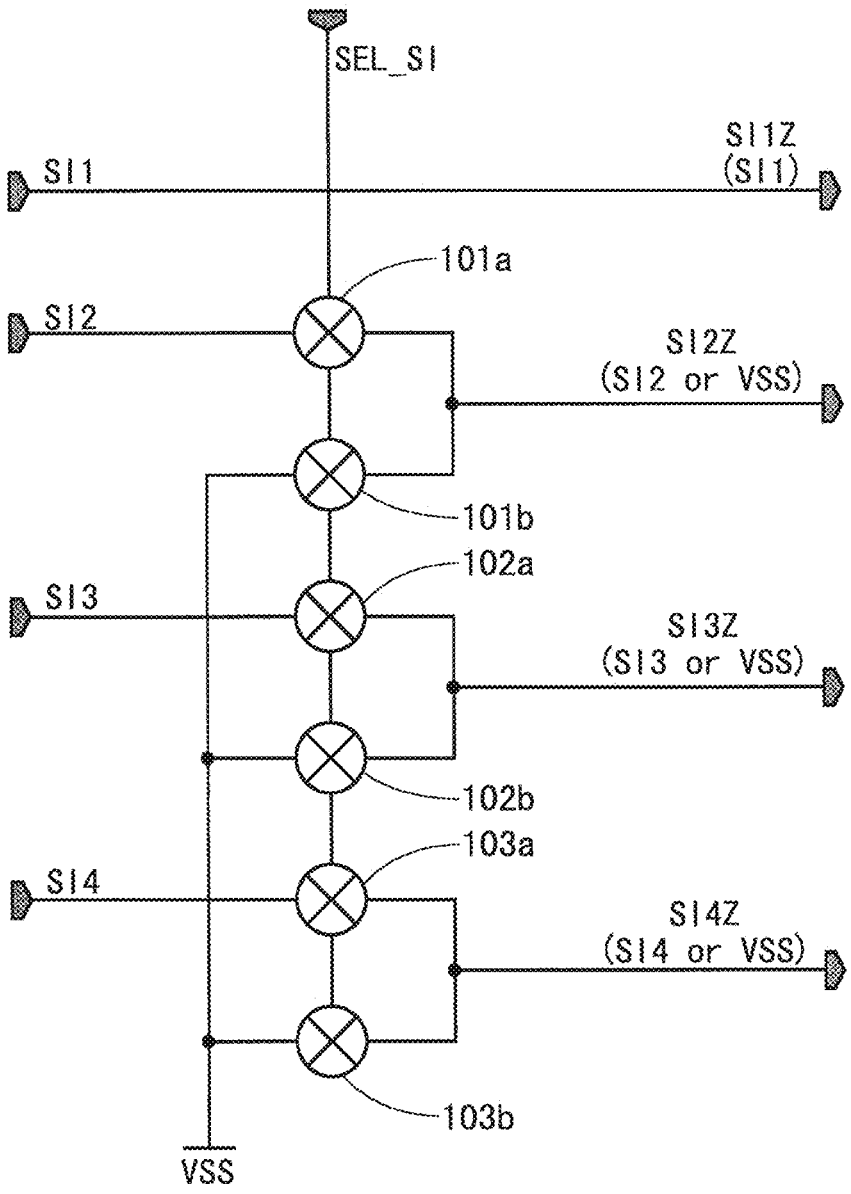
FIG. 6 is a circuit diagram illustrating a detailed configuration of an SI signal selection circuit according to the first embodiment.

FIG. 6 is a circuit diagram illustrating a detailed configuration of the SI signal selection circuit 100. As shown in FIG. 6, the SI signal selection circuit 100 includes six switches 101*a*, 101*b*, 102*a*, 102*b*, 103*a*, and 103*b*. The states of the six switches 101*a*, 101*b*, 102*a*, 102*b*, 103*a*, and 103*b* are controlled by the serial data selection signal SEL_SI. More specifically, when the serial data selection signal SEL_SI is at the high level, the switches 101*a*, 102*a*, and 103*a* turn off, and the switches 101*b*, 102*b*, and 103*b* turn on. As a result, the serial data SI1 is output as serial data SI1Z, and the potential of the signal line for the serial data SI2Z to SI4Z is given by VSS (that is, the serial data SI2Z to SI4Z become invalid). On the other hand, when the serial data selection signal SEL_SI is at the low level, the switches 101*a*, 102*a*, and 103*a* turn on, and the switches 101*b*, 102*b*, and 103*b* are turn off. As a result, the serial data SI1 is output as the serial data SI1Z, the serial data SI2 is output as the serial data SI2Z, the serial data SI3 is output as the serial data SI3Z, and the serial data SI4 is output as the serial data SI4Z.

As can be seen from the above description, when the serial data selection signal SEL_SI is at the high level, only the serial data SI1Z is supplied as valid data from the SI signal selection circuit 100 to the data conversion circuits 140*a*(1) to 140*a*(4). When the data selection signal SEL_SI is at the low level, the SI signal selection circuit 100 supplies the serial data SI1Z to SI4Z as valid data to the data conversion circuits 140*a*(1) to 140*a*(4). As described above, the SI signal selection circuit 100 switches the data to be captured as the processing target between one serial data SI1 and four serial data SI1 to SI4 according to the serial data selection signal SEL_SI.

1.3.1.2 Clock Generation Circuit

Figure 7:
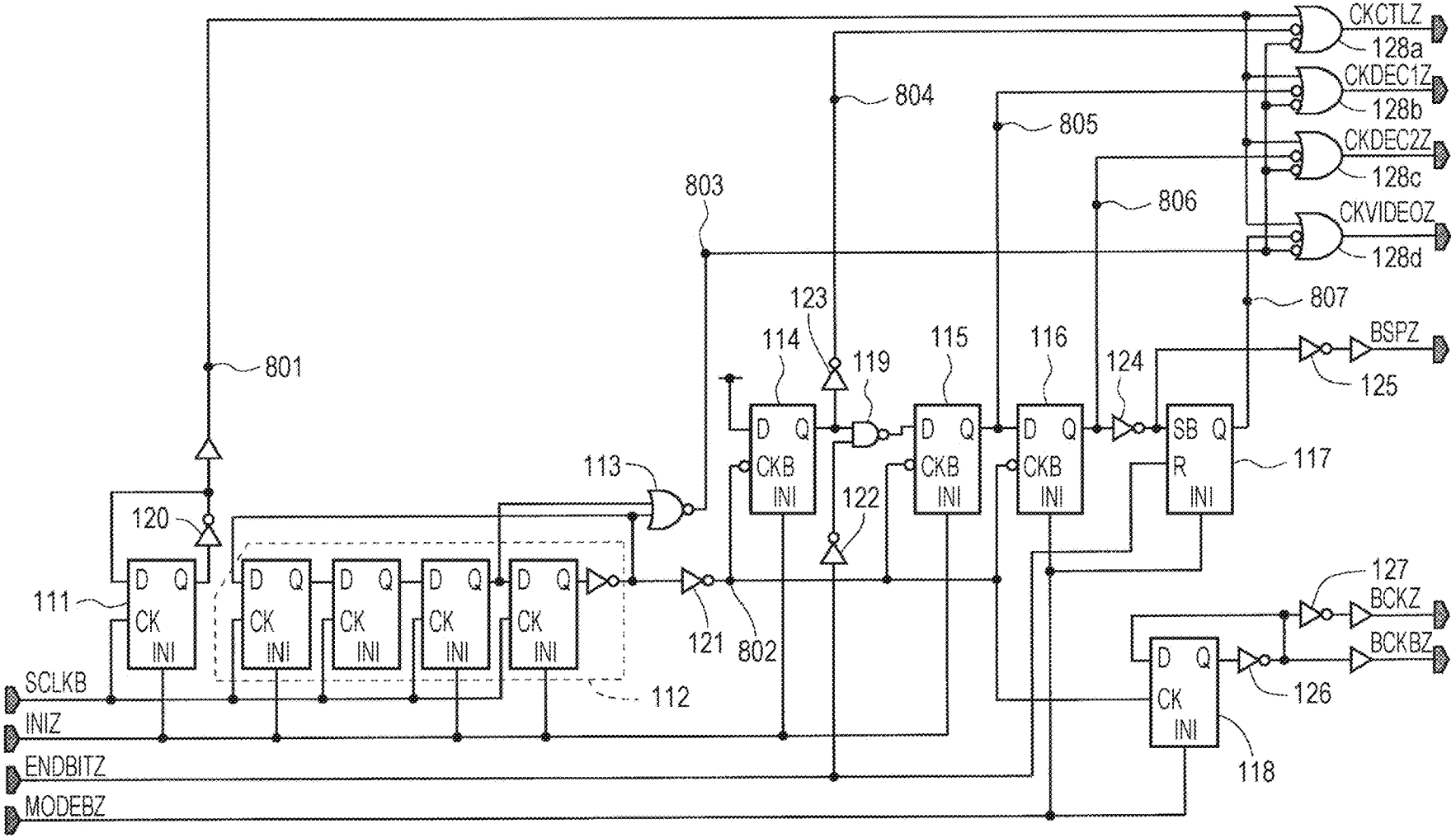
FIG. 7 is a circuit diagram illustrating a detailed configuration of a clock generation circuit according to the first embodiment.

FIG. 7 is a circuit diagram illustrating a detailed configuration of the clock generation circuit 110*a*. As shown in FIG. 7, the clock generation circuit 110*a* includes a D flip-flop 111, a circuit unit 112 including four D flip-flops and one inverter, a NOR circuit 113, a D flip-flop 114, a D flip-flop 115, a flip-flop 116, a flip-flop circuit 117, a D flip-flop 118, a NAND circuit 119, inverters 120 to 127, OR circuits 128*a* to 128*d*, and a plurality of buffers. The flip-flop circuit 117 operates according to the truth table shown in FIG. 8. Not that a serial clock SCLKB is an inverted logic signal of the serial clock SCLK.

Figures 8, 9:
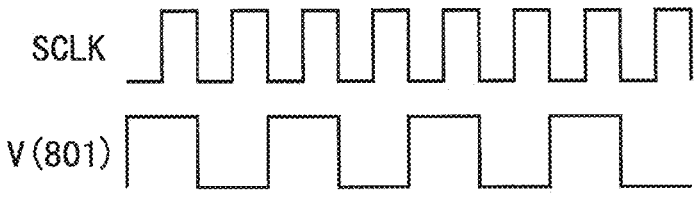
FIG. 8 is a truth table illustrating an operation of a flip-flop circuit in the clock generation circuit according to the first embodiment.
FIG. 9 is a signal waveform diagram for explaining a change in a potential at a node 801 in the clock generation circuit according to the first embodiment.
Figure 10:
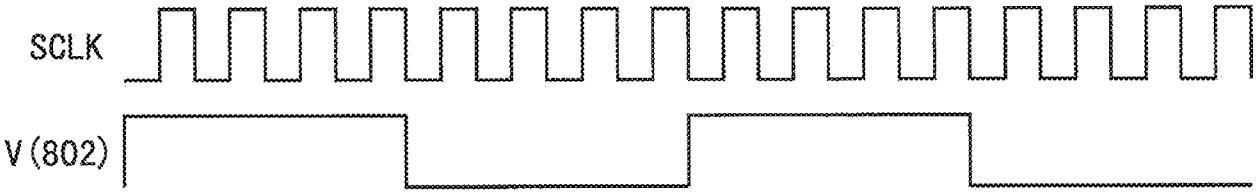
FIG. 10 is a signal waveform diagram for explaining a change in a potential at a node 802 in the clock generation circuit according to the first embodiment.
Figure 11:
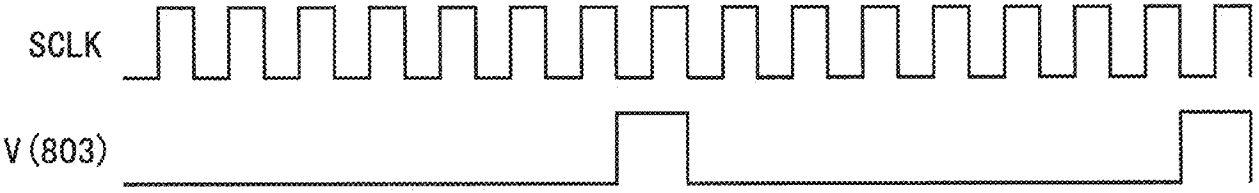
FIG. 11 is a signal waveform diagram for explaining a change in a potential at a node 803 in the clock generation circuit according to the first embodiment.

The D flip-flop 111 and the inverter 120 are provided and the D flip-flop 111 operates according to the serial clock SCLKB, and thus a potential V (801) of a node 801 is switched between the high level and the low level in accordance with each clock of the serial clock SCLK as shown in FIG. 9. The circuit unit 112 includes four D flip-flops and these four D flip-flops operate according to the serial clock SCLKB, and thus a potential of a node 802 is switched between the high level and the low level every four clocks of the serial clock SCLK as shown in FIG. 10. The circuit unit 112 and the NOR circuit 113 operate such that a potential of a node 803 is at a high level for a period of one clock of the serial clock SCLK every eight clocks of the serial clock SCLK, as shown in FIG. 11. The D flip-flop 114 and the inverter 123 are provided and the control signal INIZ is at the high level for a predetermined period in each frame, and thus a potential of a node 804 is at the high level only for a predetermined period at the beginning of each frame period. The inverter 122, the NAND circuit 119, and the D flip-flop 115 are provided and thus a potential of a node 805 goes to the high level when a period of 8 clocks of the serial clock SCLK elapses since the potential of the node 804 goes to the high level. The D flip-flop 116 is provided and thus a potential of a node 806 goes to the high level when a period of 8 clocks of the serial clock SCLK elapses since the potential of the node 805 goes to the high level. The inverter 124 and the flip-flop circuit 117 are provided and thus, when the output from the inverter 124 changes from the high level to the low level in each horizontal scanning period (when the control signal BSPZ changes from the low level to the high level in each horizontal scanning period), the potential of the node 807 is maintained at the high level over a period thereafter in the horizontal scanning period. The D flip-flop 118 and the inverters 126 and 127 are provided, and thus the potential of a control signal BCKZ is switched between the high level and the low level every four clocks of the serial clock SCLK. Note that the control signal BCKBZ is an inverted logic signal of the control signal BCKZ.

Figure 12:
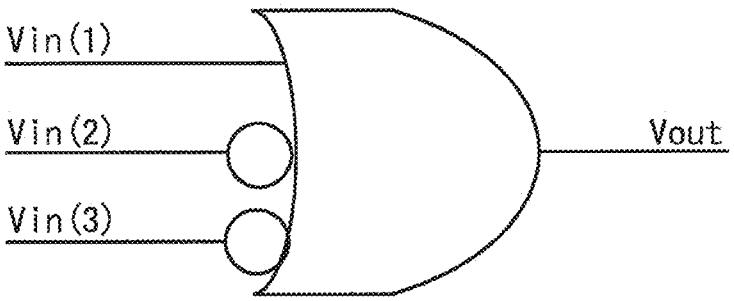
FIG. 12 is a diagram for explaining an OR circuit provided in the clock generation circuit according to the first embodiment.

Each of the OR circuits 128*a* to 128*d* is configured as shown in FIG. 12. Let a potential given to a first input terminal be denoted by Vin(1), a potential given to a second input terminal be denoted by Vin(2), a potential given to a third input terminal be denoted by Vin(3), and a potential of an output terminal be denoted by Vout. The potential Vout is at the low level only when the potential Vin(1) is at the low level, the potential Vin(2) is at the high level, and the potential Vin(3) is at the high level. In any other states, the potential Vout is at the high level. The potential of the node 801 is commonly given to the first input terminals of all OR circuits 128*a* to 128*d*, and the potential of the node 803 is commonly given to the third input terminals of all OR circuits 128*a* to 128*d*. Furthermore, the potential of the node 804 is given to the second input terminal of the OR circuit 128*a*, the potential of the node 805 is given to the second input terminal of the OR circuit 128*b*, the potential of the node 806 is given to the second input terminal of the OR circuit 128*c*, and the potential of the node 807 is given to the second input terminal of the OR circuit 128*d*.

In the above-described configuration, waveforms of the control signal CKCTLZ, the control signal CKDEC1Z, the control signal CKDEC2Z, the control signal CKVIDEOZ, the control signal BSPZ, and the control signal BCKZ, which are output from the clock generation circuit 110*a*, are as shown in FIG. 4 and FIG. 5.

1.3.1.3 Data Conversion Circuit

Figure 13:
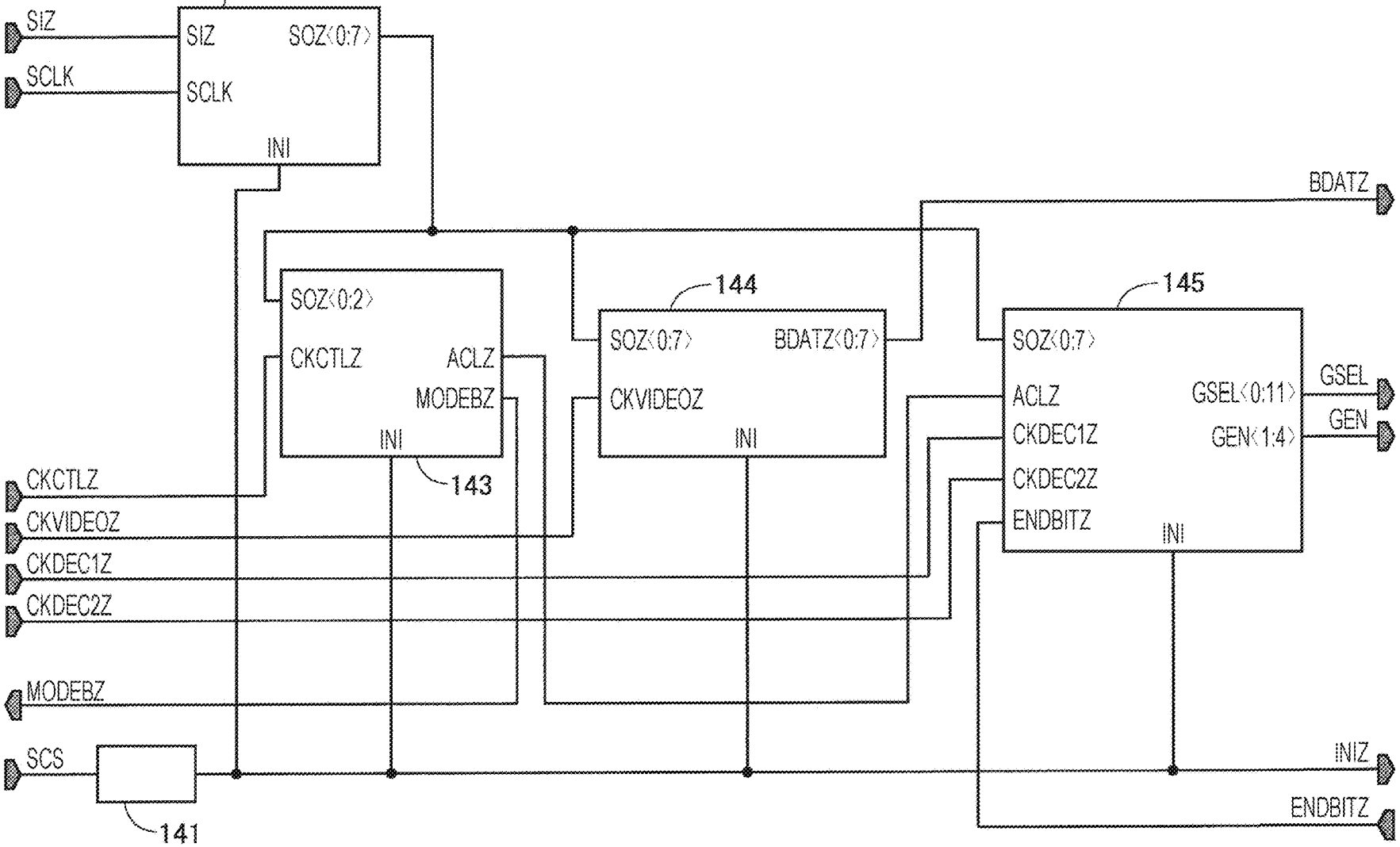
FIG. 13 is a block diagram illustrating a configuration of a data conversion circuit according to the first embodiment.

FIG. 13 is a block diagram illustrating a configuration of the data conversion circuit 140*a* (an arbitrary one of the four data conversion circuits 140*a*(1) to 140*a*(4)). The data conversion circuit 140*a* includes a buffer 141, a serial-parallel conversion circuit 142, a mode flag processing circuit 143, an image data processing circuit 144, and a gate line address processing circuit 145. The serial chip select signal SCS is given, as a control signal INI, via the buffer 141, to the serial-parallel conversion circuit 142, the mode flag processing circuit 143, the image data processing circuit 144, and the gate line address processing circuit 145, and is output as a control signal INIZ from this data conversion circuit 140*a*.

Figure 14:
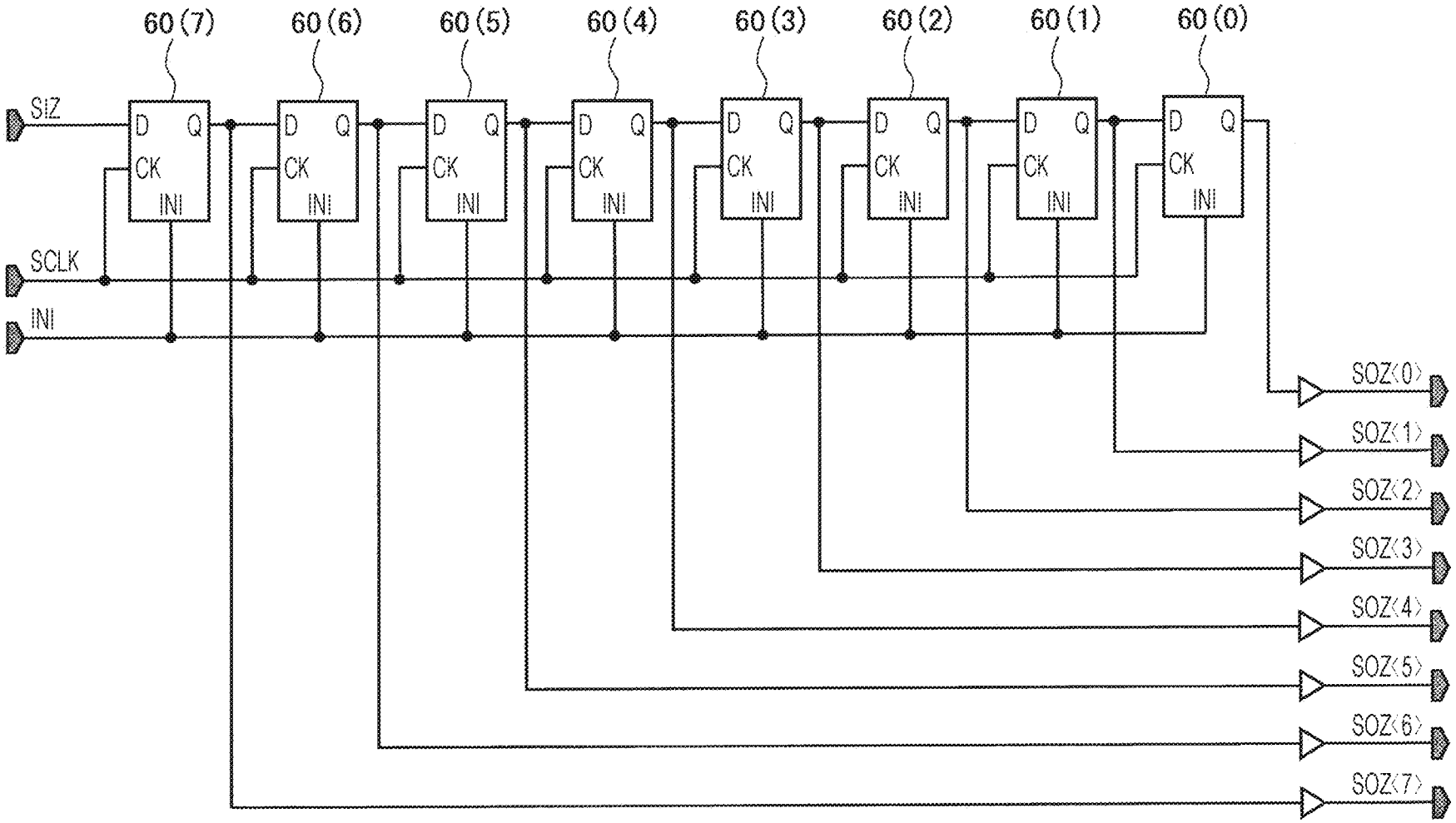
FIG. 14 is a circuit diagram illustrating a detailed configuration of a serial-parallel conversion circuit according to the first embodiment.

The serial-parallel conversion circuit 142 receives the serial data SIZ, the serial clock SCLK, and the control signal INI. FIG. 14 is a circuit diagram illustrating a detailed configuration of the serial-parallel conversion circuit 142. The serial-parallel conversion circuit 142 includes eight D flip-flops 60(0) to 60(7) and eight buffers. The eight D flip-flops 60(0) to 60(7) form a shift register. That is, each time a clock pulse of the serial clock SCLK occurs, the serial data SIZ is transferred bit by bit from the D flip-flop 60(7) to the D flip-flop 60(0). Then 8-bit data of the serial data SIZ is output from the serial-parallel conversion circuit 142 as parallel data SOZ<0> to SOZ<7>. As described above, the serial-parallel conversion circuit 142 performs the serial-parallel conversion process on the serial data SIZ output from the SI signal selection circuit 100.

As can be seen from FIG. 4, at the beginning of each frame period, the flag data M0 to M2 and the five pieces of dummy data Dum are given as the serial data SIZ to the serial-parallel conversion circuit 142. As a result, the flag data M0 is output as parallel data SOZ<0>, the flag data M1 is output as parallel data SOZ<1>, and the flag data M2 is output as parallel data SOZ<2>. Next, at the beginning of each horizontal scanning period, the gate address data AG0 to AG7 are given as the serial data SIZ to the serial-parallel conversion circuit 142. As a result, the gate address data AG0 to AG7 are respectively output as parallel data SOZ<0> to SOZ<7>. After that, image data is given as the serial data SIZ to the serial-parallel conversion circuit 142. The image data is subjected to the serial-parallel conversion process in units of eight pieces of data (eight bits of data). That is, eight pieces of image data are output as parallel data SOZ<0> to SOZ<7> via one serial-parallel conversion process.

In the case where four serial data lines are used (when the serial data selection signal SEL_SI is set to the low level), the parallel conversion circuits 142 in the four data conversion circuits 140*a*(1) to 140*a*(4) perform the serial-parallel conversion processes in parallel on the serial data SI1Z to SI4Z.

Figure 15:
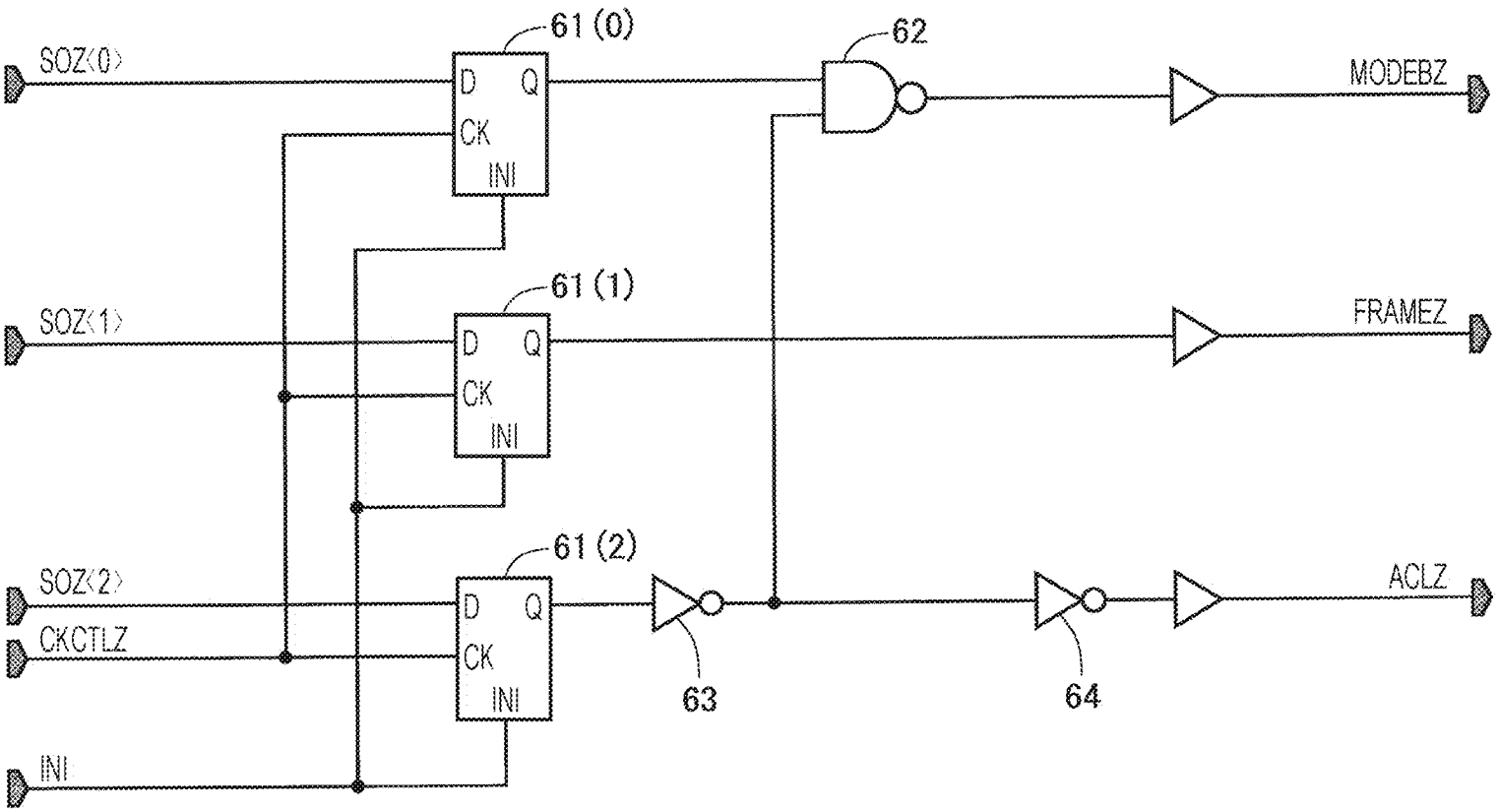
FIG. 15 is a circuit diagram showing a detailed configuration of a mode flag processing circuit according to the first embodiment.

In addition to the control signal INI and the control signal CKCTLZ, 3 bits of the parallel data SOZ<0> to SOZ<7>, that is, parallel data SOZ<0> to SOZ<2> are also given to the mode flag processing circuit 143. FIG. 15 is a circuit diagram illustrating a detailed configuration of the mode flag processing circuit 143. The mode flag processing circuit 143 includes three D flip-flops 61(0) to 61(2), a NAND circuit 62, two inverters 63 and 64, and three buffers. The control signal INI and the control signal CKCTLZ are commonly given to the three D flip-flops 61(0) to 61(2). The parallel data SOZ<0> is given to a D input terminal of the D flip-flop 61(0), the parallel data SOZ<1> is given to a D input terminal of the D flip-flop 61(1), and parallel data SOZ<2> is given to a D input terminal of 61(2). The NAND circuit 62 receives an output from a Q output terminal of the D flip-flop 61(0) and an inverted logic signal of an output from a Q output terminal of the D flip-flop 61(2). In the configuration described above, waveforms of the control signal MODEBZ, the control signal FRAMEZ, and the control signal ACLZ are determined by values of flag data M0 to M2 included in serial data SI captured immediately before a point of time (a point of time t11 in FIG. 4) at which the control signal CKCTLZ changes from the low level to the high level (see FIG. 4 and FIG. 5). Note that the control signal FRAMEZ is a signal used to set the potential of the common electrode 543 and is not directly related to the gist of the present disclosure. Therefore, the control signal FRAMEZ is not shown in FIG. 13.

Figure 16:
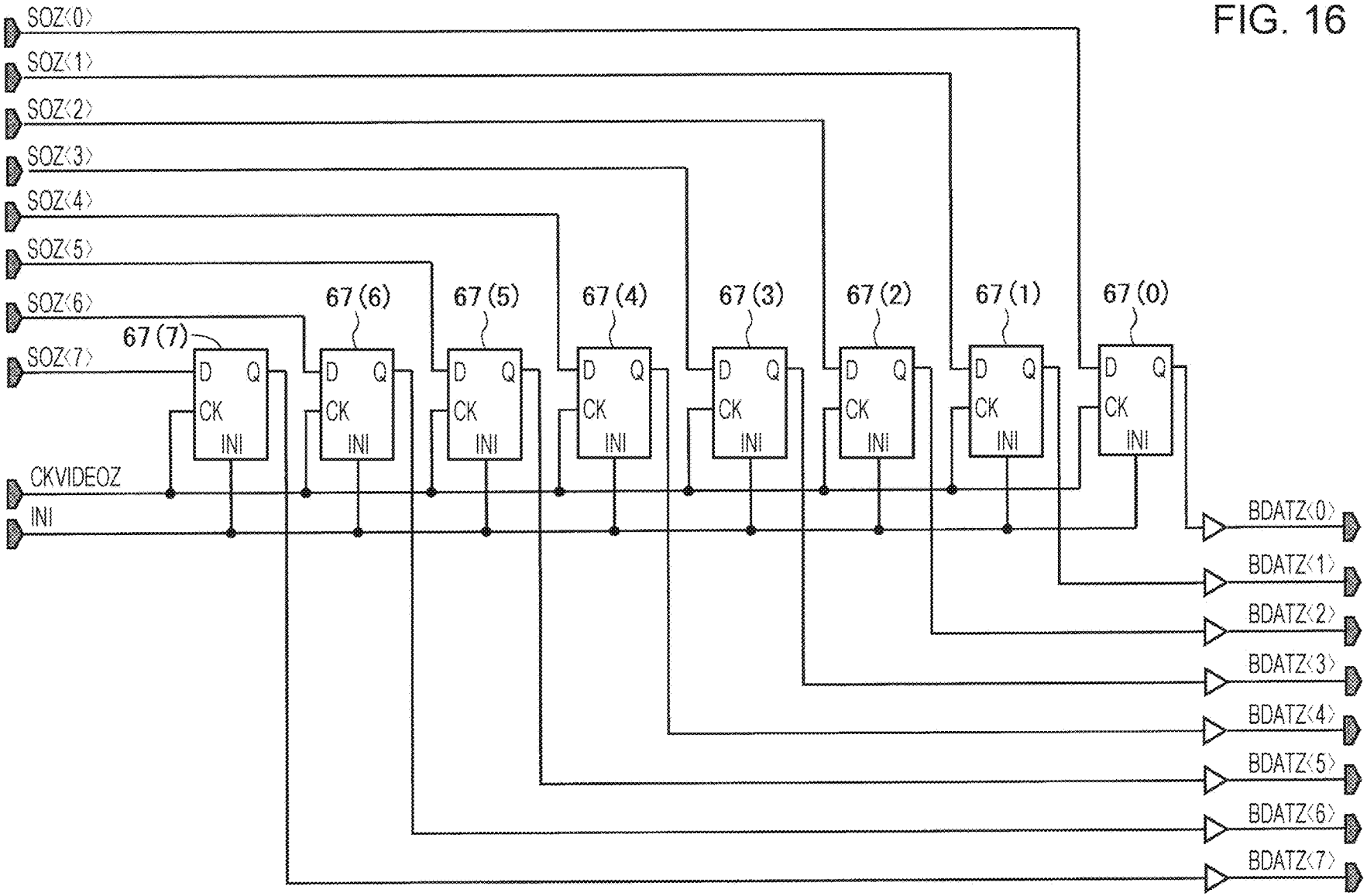
FIG. 16 is a circuit diagram showing a detailed configuration of the image data processing circuit according to the first embodiment.

The image data processing circuit 144 receives the control signal INI and the control signal CKVIDEOZ and furthermore the parallel data SOZ<0> to SOZ<7> output from the serial-parallel conversion circuit 142. FIG. 16 is a circuit diagram illustrating a detailed configuration of the image data processing circuit 144. The image data processing circuit 144 includes eight D flip-flops 67(0) to 67(7) and eight buffers. The control signal INI and the control signal CKVIDEOZ are commonly given to the eight D flip-flops 67(0) to 67(7). The parallel data SOZ<0> to SOZ<7> are respectively given to D input terminals of the D flip-flops 67(0) to 67(7). In the configuration described above, the parallel data SOZ<0> to SOZ<7> are respectively output as binary data BDATZ<0> to BDATZ<7> from the image data processing circuit 144. More specifically, since the image data processing circuit 144 operates according to the control signal CKVIDEOZ (see FIG. 4 and FIG. 5), the parallel data SOZ<0> to SOZ<7>, which originate from the image data, are output respectively as binary data BDATZ<0> to BDATZ<7> from the image data processing circuit 144. Note that the binary data BDATZ in FIG. 13 and that in FIG. 16 correspond to the binary data BDAT1Z to BDAT4Z in FIG. 2.

Figure 17:
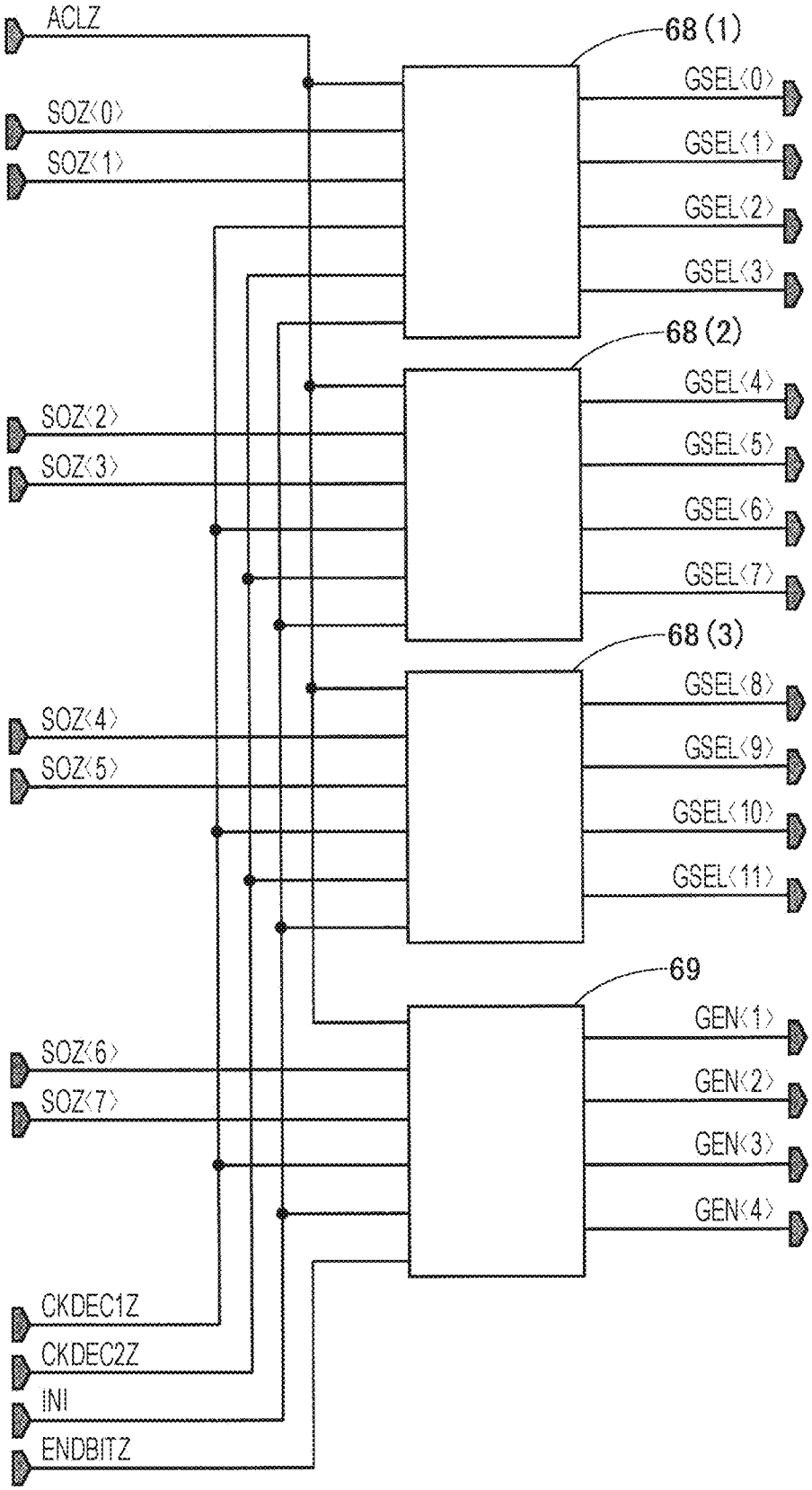
FIG. 17 is a block diagram showing a simplified representation of a configuration of a gate line address processing circuit according to the first embodiment.

The gate line address processing circuit 145 receives the control signal INI, the control signal ACLZ, the control signal CKDEC1Z, the control signal CKDEC2Z, and the control signal ENDBITZ, and also the parallel data SOZ<0> to SOZ<7> output from the serial-parallel conversion circuit 142. FIG. 17 is a block diagram illustrating a schematic configuration of the gate line address processing circuit 145. The gate line address processing circuit 145 includes three gate selection signal generation circuits 68(1) to 68(3) and a gate enable signal generation circuit 69.

Figure 18:
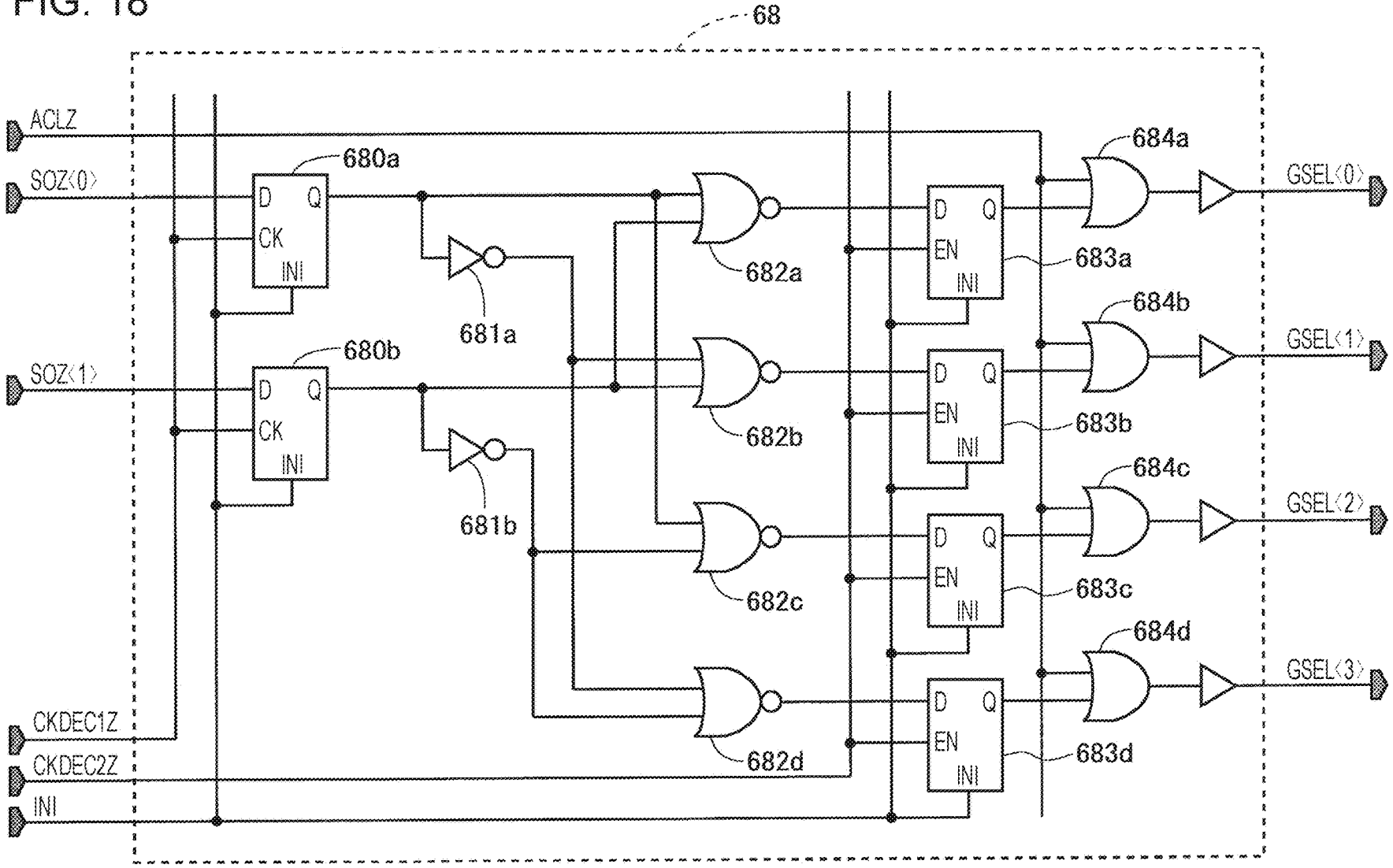
FIG. 18 is a circuit diagram showing a detailed configuration of a gate selection signal generation circuit according to the first embodiment.

FIG. 18 is a circuit diagram illustrating a detailed configuration of the gate selection signal generation circuit 68(1). Note that the gate selection signal generation circuits 68(2) and 68(3) have the same configuration as that of the gate selection signal generation circuit 68(1). The gate selection signal generation circuit 68(1) receives the control signal INI, the control signal ACLZ, the control signal CKDEC1Z, the control signal CKDEC2Z, the parallel data SOZ<0>, and the parallel data SOZ<1>. The gate selection signal generation circuit 68(1) includes two D flip-flops 680*a* and 680*b*, two inverters 681*a* and 681*b*, four NOR circuits 682*a*, 682*b*, 682*c*, and 682*d*, and four D-latches 683*a*, 683*b*, 683*c*, and 683*d*, four OR circuits 684*a*, 684*b*, 684*c*, and 684*d*, and four buffers. In the configuration shown in FIG. 18, when the control signal ACLZ is at the low level, one of the four gate selection signals GSEL<0> to GSEL<3> is at the high level depending on the combination of the parallel data SOZ<0> and the parallel data SOZ<1>. When the control signal ACLZ is at the high level, the four gate selection signals GSEL<0> to GSEL<3> are all at the high level. As can be seen from FIG. 18, the four D latches 683*a*, 683*b*, 683*c*, and 683*d* operate according to the control signal CKDEC2Z. Thus, in each horizontal scanning period, at a time point (for example, at a time point t13 in FIG. 4 or a time point t24 in FIG. 5) at which the control signal CKDEC2Z changes from the low level to the high level, valid gate selection signals GSEL<0> to GSEL<11> are output from the gate line address processing circuit 145.

Figure 19:
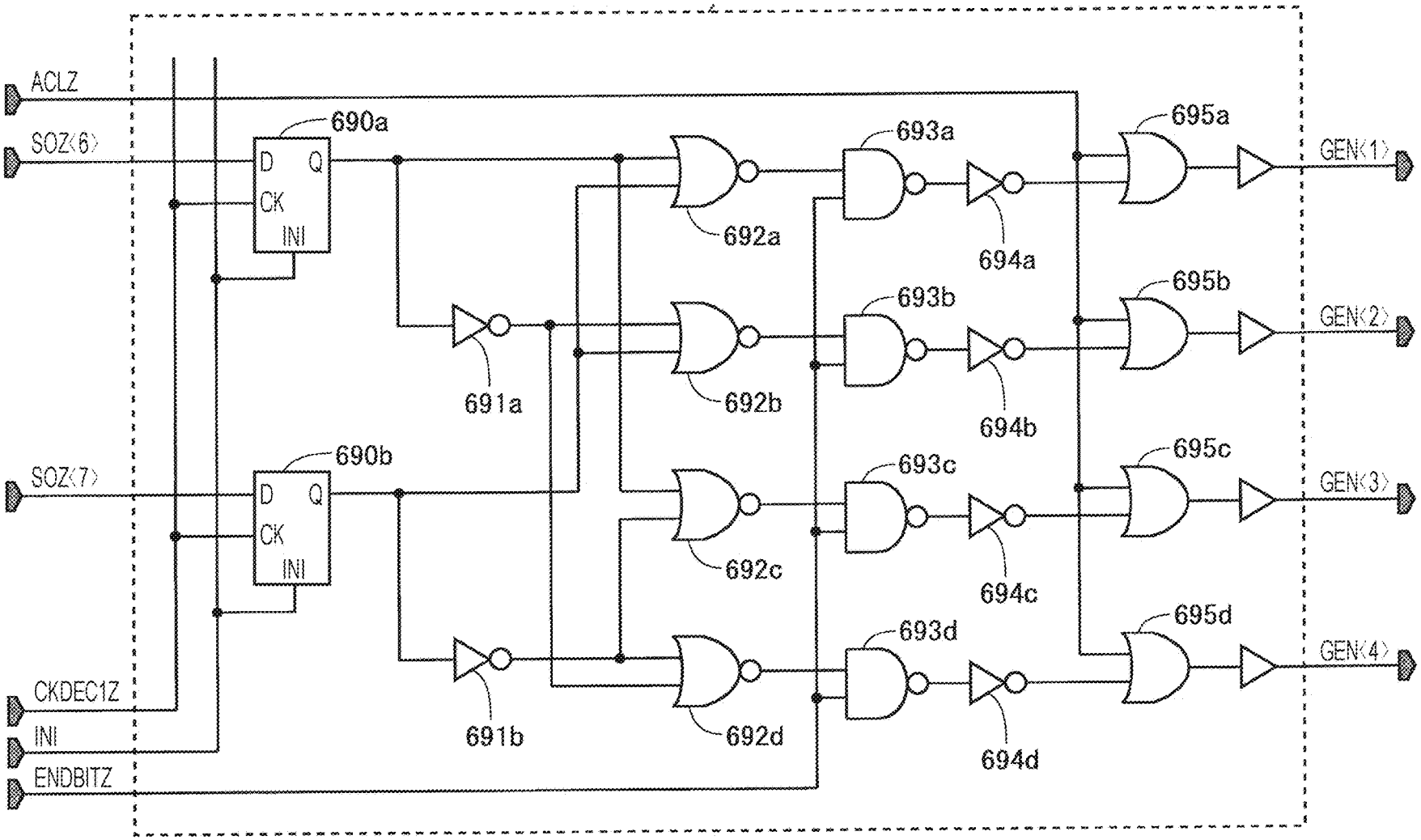
FIG. 19 is a circuit diagram showing a detailed configuration of a gate enable signal generation circuit according to the first embodiment.

FIG. 19 is a circuit diagram illustrating a detailed configuration of the gate enable signal generation circuit 69. The gate enable signal generation circuit 69 receives the control signal INI, the control signal ACLZ, the control signal CKDEC1Z, the control signal ENDBITZ, the parallel data SOZ<6>, and the parallel data SOZ<7>. The gate enable signal generation circuit 69 includes two D flip-flops 690*a* and 690*b*, two inverters 691*a* and 691*b*, four NOR circuits 692*a*, 692*b*, 692*c*, and 692*d*, and four NAND circuits 693*a*, 693*b*, 693*c*, and 693*d*, four inverters 694*a*, 694*b*, 694*c*, and 694*d*, four OR circuits 695*a*, 695*b*, 695*c*, and 695*d*, and four buffers. In the configuration shown in FIG. 19, when the control signal ACLZ is at the low level and the control signal ENDBITZ is at the high level, one of the four gate enable signals GEN<1> to GEN<4> is at the high level depending on the combination of the parallel data SOZ<6> and the parallel data SOZ<7>. When the control signal ACLZ is at the high level, the four gate enable signals GEN<1> to GEN<4> are all at the high level. When the control signal ACLZ is at the low level and the control signal ENDBITZ is at the low level, the four gate enable signals GEN<1> to GEN<4> are all at the low level. The control signal ENDBITZ is at the high level only for a period corresponding to 8 clocks of the serial clock SCLK after the data signals are applied to all the data signal lines in each horizontal scanning period (for example, a period from a time point t20 to a time point t22 shown in FIG. 5). Therefore, in this period, one of the four gate enable signals GEN<1> to GEN<4> is at the high level depending on a row to which the data signal is written (however, the control signal ACLZ is assumed to be maintained at the low level).

The gate line address processing circuit 145 operates according to the control signal CKDEC1Z (see FIG. 4 and FIG. 5). Therefore, the gate line address processing circuit 145 operates when the parallel data SOZ<0> to SOZ<7> are given, whose original data are the gate address data AG0 to AG7. Therefore, the gate line address processing circuit 145 outputs the gate selection signal GESL and the gate enable signal GEN depending on a row specified by a combination of eight pieces of gate address data AG0 to AG7.

In the present embodiment, when the serial data selection signal SEL_SI is at the high level, valid binary data is output only by the data conversion circuit 140*a*(1) among the four data conversion circuits 140*a*(1) to 140*a*(4). In contrast, when the serial data selection signal SEL_SI is at the low level, valid binary data is output from each of all the four data conversion circuits 140*a*(1) to 140*a*(4). In this state, binary data BDAT1Z to BDAT4Z are transmitted simultaneously in parallel from the four data conversion circuits 140*a*(1) to 140*a*(4) to the binary driver 20*b*. Therefore, when valid binary data BDAT1Z to BDAT4Z are transmitted from the four data conversion circuits 140*a*(1) to 140*a*(4) to the binary driver 20*b*, the data transmission rate is four times the data transmission rate when the valid binary data BDAT1Z is transmitted from the data conversion circuit 140*a*(1) to the binary driver 20*a*.

The control signal INIZ, the control signal MODEBZ, the gate selection signal GSEL, and the gate enable signal GEN are output from the data conversion circuit 140*a*(1), but are not output from the data conversion circuit 140*a*(2) to 140*a*(4).

1.3.2 Binary Driver and Output Selection Circuit

Figure 20:
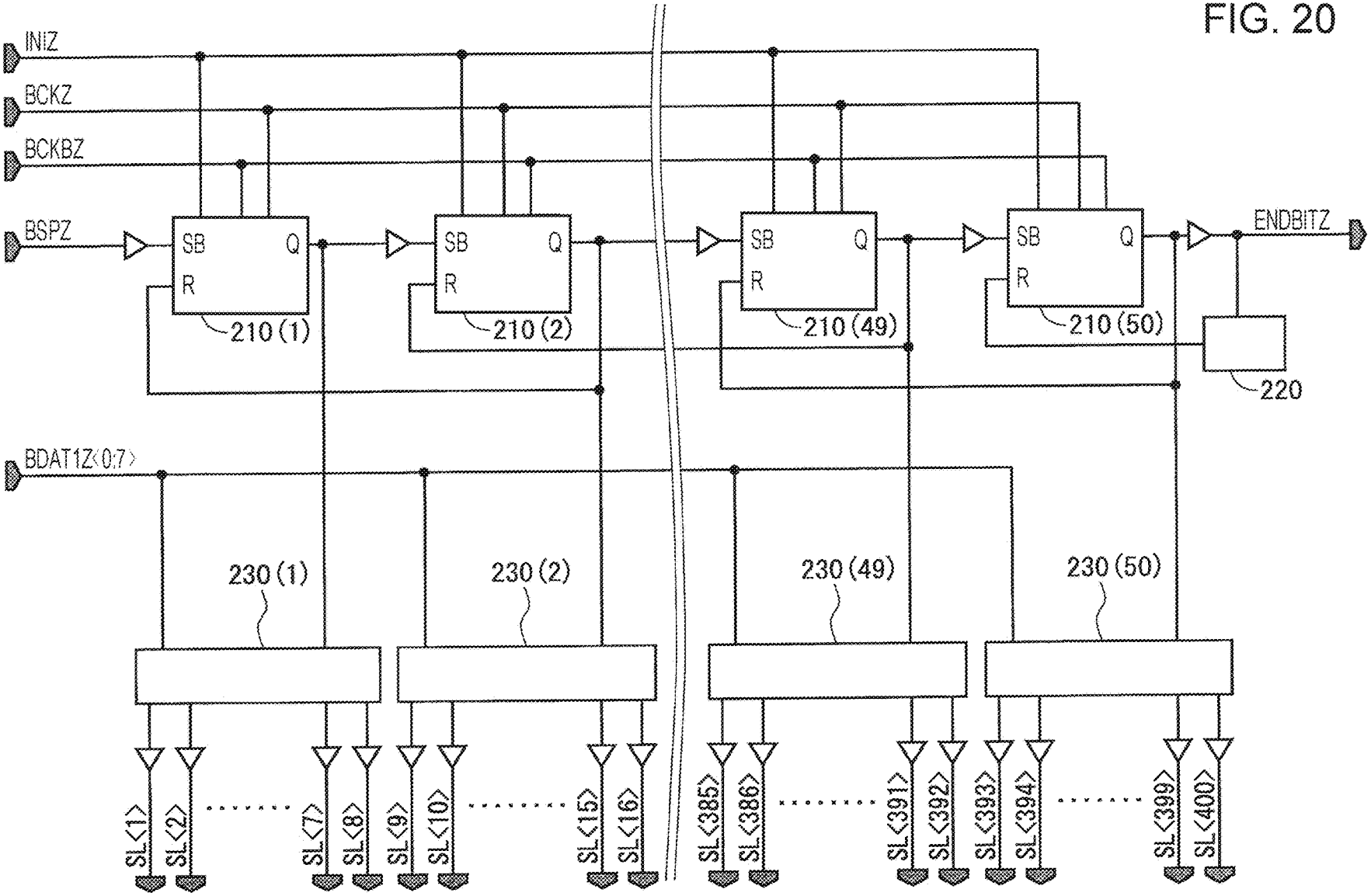
FIG. 20 is a circuit diagram showing a detailed configuration of a binary driver 20*a* according to the first embodiment.

FIG. 20 is a circuit diagram illustrating a detailed configuration of the binary driver 20*a*. The control signal INIZ, the control signal BCKZ, the control signal BCKBZ, the control signal BSPZ, and the binary data BDAT1Z are given to the binary driver 20*a*. Note that, as described above, the binary data BDAT1Z includes eight pieces of 1-bit data. The binary driver 20*a* includes fifty flip-flop circuits 210(1) to 210(50), a reset signal generation circuit 220, fifty latch circuits 230(1) to 230(50), and a plurality of buffers. The reset signal generation circuit 220 generates a reset signal R for the flip-flop circuit 210(50). In the configuration shown in FIG. 20, in each horizontal scanning period, after the control signal BSPZ changes from the low level to the high level, each time the logical levels of the control signal BCKZ and the control signal BCKBZ are inverted, the latch circuit 230 captures the binary data BDAT1Z<0:7> to BDAT4Z<0:7>. That is, each time the logic levels of the control signal BCKZ and the control signal BCKBZ are inverted, 8-bit data is captured into the latch circuit 230. Therefore, after the control signal BSPZ changes from the low level to the high level, when the logic levels of the control signal BCKZ and the control signal BCKBZ are inverted 50 times, the capturing of binary data is completed for all latch circuits 230(1) to 230(50) corresponding to the entire columns. After that, the control signal ENDBITZ output from the binary driver 20*a* is at the high level only for a period corresponding to 8 clocks of the serial clock SCLK (for example, for a period from time t20 to time t22 in FIG. 5). The binary data BDAT1Z captured in the latch circuits 230(1) to 230(50) are applied as data signals SL<1> to SL<400> to the data signal lines.

Figure 21:
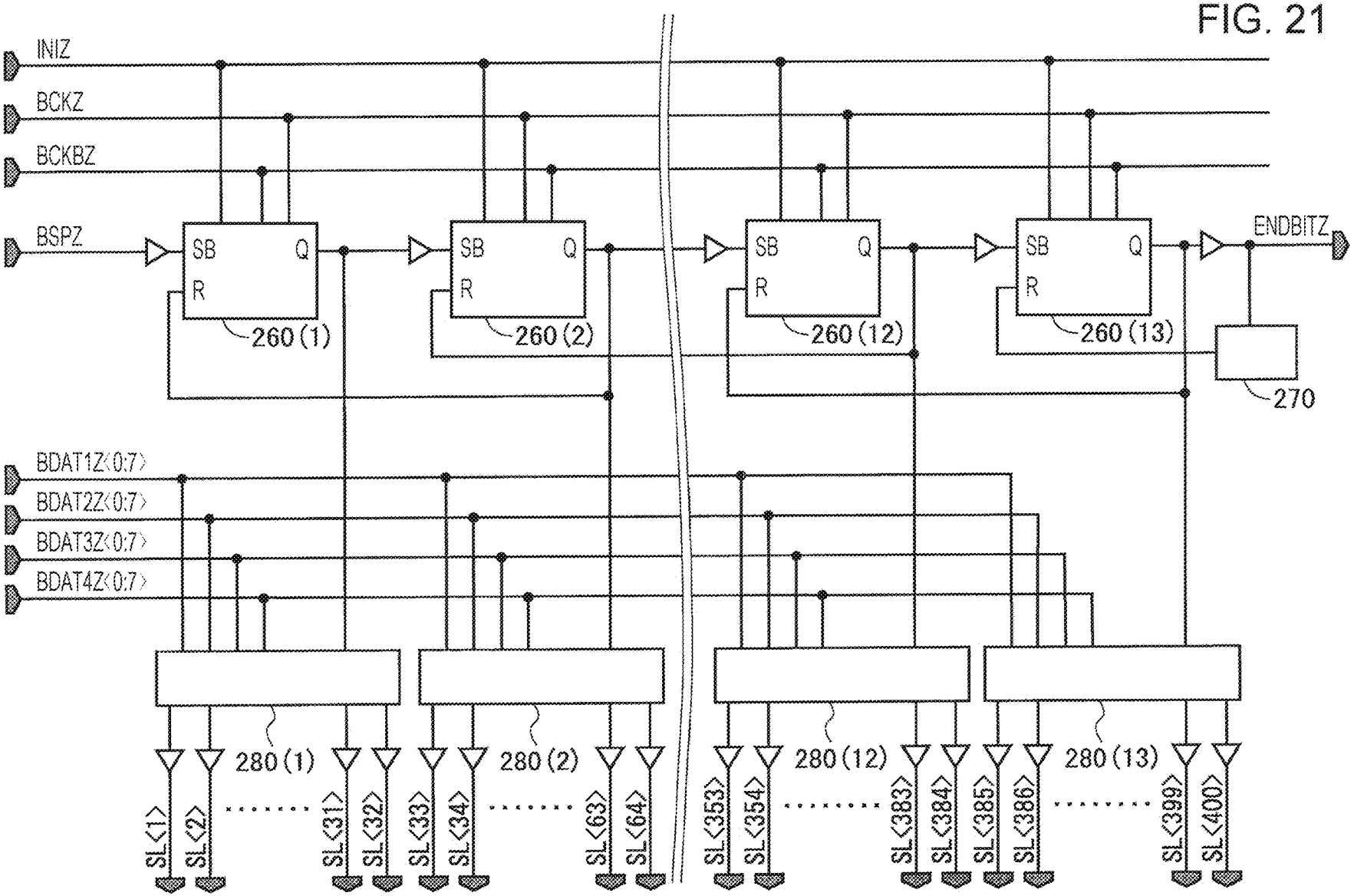
FIG. 21 is a circuit diagram showing a detailed configuration of a binary driver 20*b* according to the first embodiment.

FIG. 21 is a circuit diagram illustrating a detailed configuration of the binary driver 20*b*. The binary driver 20*b* receives the control signal INIZ, the control signal BCKZ, the control signal BCKBZ, the control signal BSPZ, and the binary data BDAT1Z to BDAT4Z. Regarding the binary data, only the binary data BDAT1Z output from the data conversion circuit 140*a*(1) is given to the binary driver 20*a* (see FIG. 20), whereas in contrast, binary data BDAT1Z to BDAT4Z output from the data conversion circuits 140*a*(1) to 140*a*(4) are output to the binary driver 20*b*. The binary driver 20*b* includes 13 flip-flop circuits 260(1) to 260(13), a reset signal generation circuit 270, 13 latch circuits 280(1) to 280(13), and a plurality of buffers. The reset signal generation circuit 270 generates a reset signal R for the flip-flop circuit 260(13). In the configuration shown in FIG. 21, in each horizontal scanning period, after the control signal BSPZ changes from the low level to the high level, each time the logical levels of the control signal BCKZ and the control signal BCKBZ are inverted, the latch circuit 280 captures the binary data BDAT1Z<0:7> to BDAT4Z<0:7>. That is, when the logic levels of the control signal BCKZ and the control signal BCKBZ are inverted once, 32 bits of data are captured into the latch circuit 280. Therefore, after the control signal BSPZ changes from the low level to the high level, when the logic levels of the control signal BCKZ and the control signal BCKBZ are inverted 13 times, the capturing of binary data is completed for all latch circuits 280(1) to 280(13) corresponding to the entire columns. After that, the control signal ENDBITZ output from the binary driver 20*b* is at the high level only for a period corresponding to 8 clocks of the serial clock SCLK (for example, for a period from time t20 to time t22 in FIG. 5). The binary data BDAT1Z to BDAT4Z captured in the latch circuits 280(1) to 280(13) are applied as data signals SL<1> to SL<400> to the data signal lines.

Figure 22:
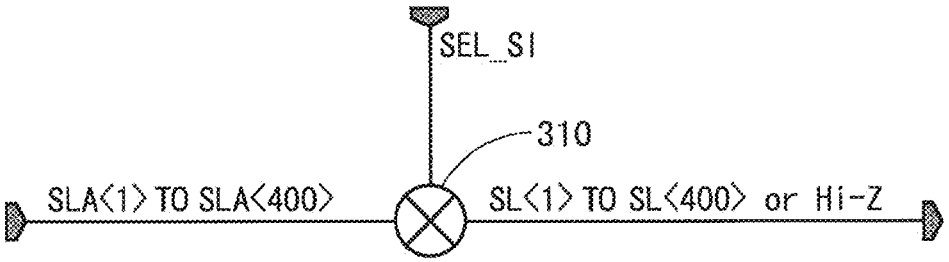
FIG. 22 is a circuit diagram showing a detailed configuration of an output selection circuit 30*a* according to the first embodiment.
Figure 23:
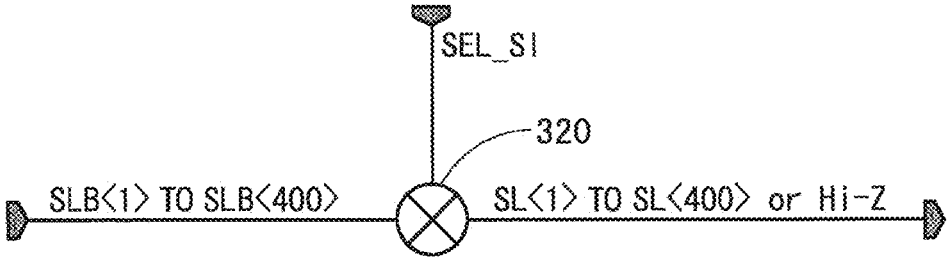
FIG. 23 is a circuit diagram showing a detailed configuration of an output selection circuit 30*b* according to the first embodiment.

FIG. 22 is a circuit diagram illustrating a detailed configuration of the output selection circuit 30*a*. FIG. 23 is a circuit diagram illustrating a detailed configuration of the output selection circuit 30*b*. Note that the data signals output from the binary driver 20*a* are denoted by symbols SLA<1> to SLA<400> in FIG. 22, and the data signals output from the binary driver 20*b* are denoted by symbols SLB<1> to SLB<400> in FIG. 23. The output selection circuit 30*a* includes a switch 310 whose state is controlled by the serial data selection signal SEL_SI. When the serial data selection signal SEL_SI is at the high level, the switch 310 turns on, and the data signals SLA<1> to SLA<400> output from the binary driver 20*a* are applied as data signals SL<1> to SL<400> to data signal lines in the active area 50. When the serial data selection signal SEL_SI is at the low level, the switch 310 turns off, and the binary driver 20*a* and the data signal line in the active area 50 are electrically disconnected. The output selection circuit 30*b* includes a switch 320 whose state is controlled by the serial data selection signal SEL_SI. When the serial data selection signal SEL_SI is at the low level, the switch 320 turns on, and the data signals SLB<1> to SLB<400> output from the binary driver 20*b* are applied as data signals SL<1> to SL<400> to data signal lines in the active area 50. When the serial data selection signal SEL_SI is at the high level, the switch 320 turns off, and the binary driver 20*b* and the data signal line in the active area 50 are electrically disconnected. Thus, when the serial data selection signal SEL_SI is at the high level, the data signal SLA<1> to SLA<400> output from the binary driver 20*a* are applied to the data signal lines in the active area 50, whereas when the serial data selection signal SEL_SI is at the low level, the data signals SLB<1> to SLB<400> output from the binary driver 20*b* are applied to the data signal lines in the active area 50.

1.3.3 Gate Driver

Figure 24:
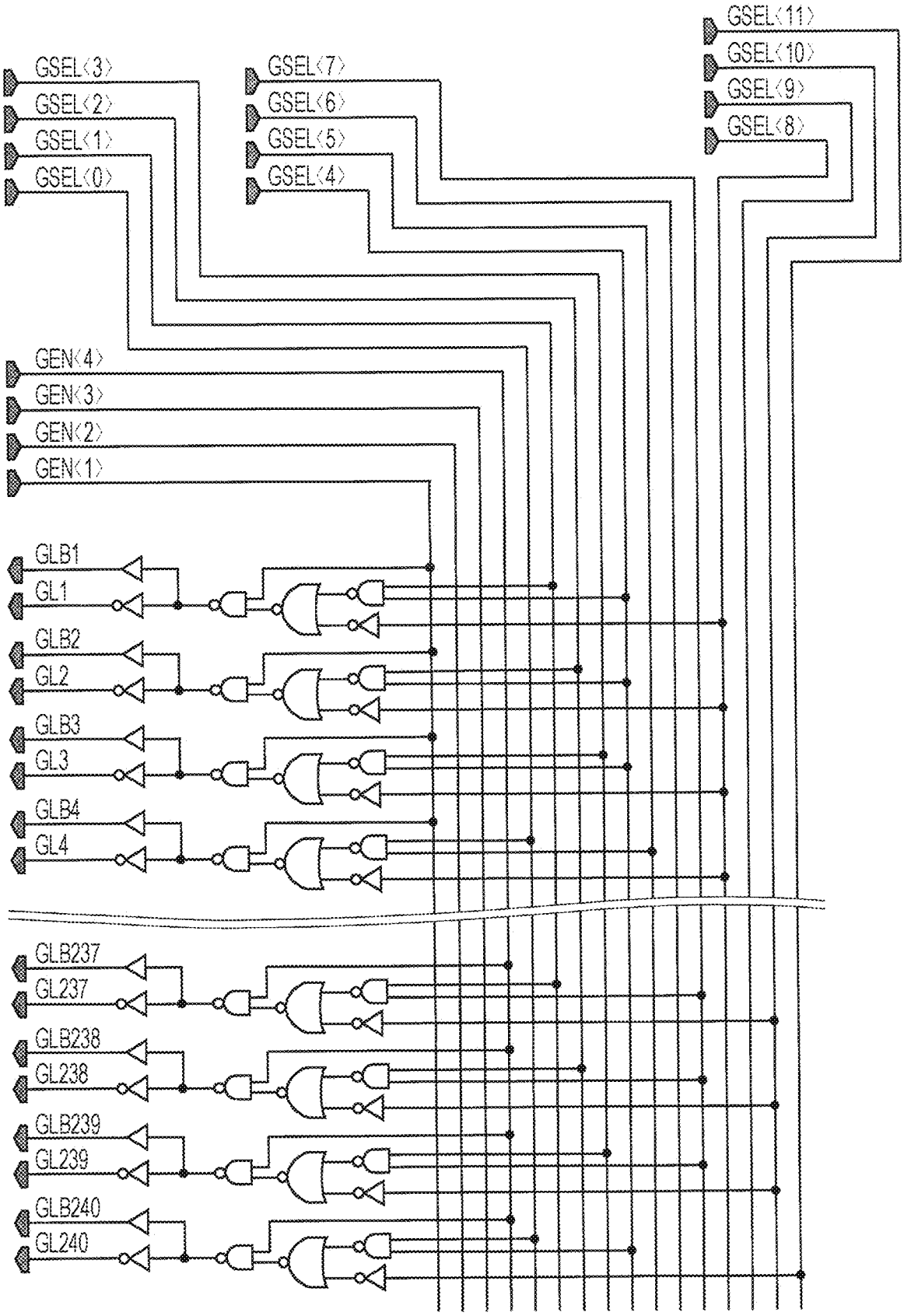
FIG. 24 is a circuit diagram showing a detailed configuration of a gate driver according to the first embodiment.
Figure 25:
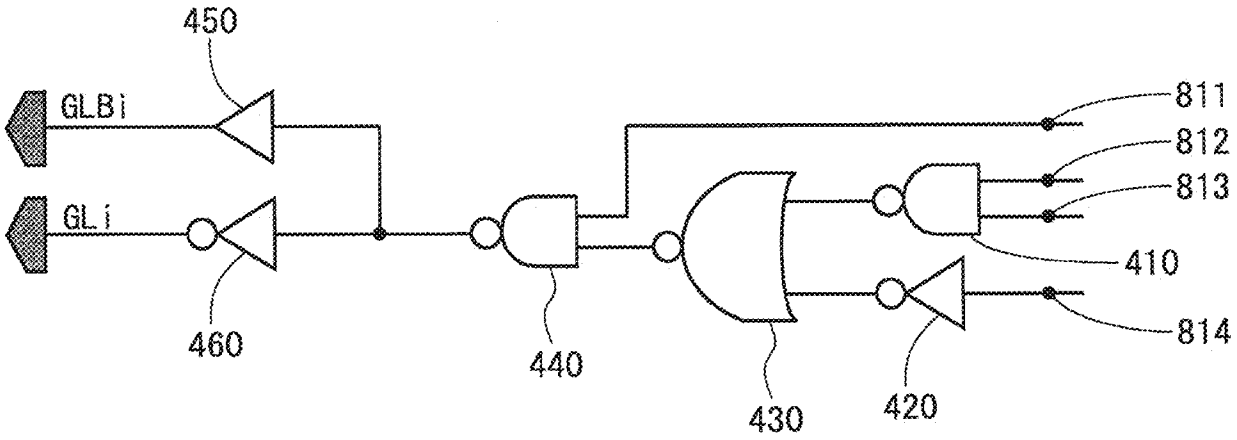
FIG. 25 is a circuit diagram showing a detailed configuration of a gate driver in one row according to the first embodiment.

FIG. 24 is a circuit diagram illustrating a detailed configuration of the gate driver 40. FIG. 25 is a circuit diagram illustrating a detailed configuration of a part relating to one row (i-th row) in the gate driver 40. In FIG. 24, scanning signals GL1 to GL240 respectively represent scanning signals applied to first scanning signal lines of the 1st to 240th rows, and scanning signals GLB1 to GLB240 respectively represent scanning signal applied to second scanning signal lines of the 1st to 240th rows. As shown in FIG. 24, the gate driver 40 receives gate selection signals GSEL<0> to GSEL<11> and gate enable signals GEN<1> to GEN<4>. As shown in FIG. 25, each row of the gate driver 40 includes a NAND circuit 410, an inverter 420, a NOR circuit 430, a NAND circuit 440, a buffer 450, and an inverter 460. With reference to FIG. 25, one of the gate enable signals GEN<1> to GEN<4> is given to a node 811, one of the gate select signal GSEL<0> to GSEL<3> is given to a node 812, one of the gate selection signals GSEL<4> to GSEL<7> is given to a node 813, and one of the gate selection signal GSEL<8> to GSEL<11> is given to a node 814. In the configuration shown in FIG. 25, when the gate enable signal given to the node 811 is at the low level, the scanning signal GLi is at the low level and the scanning signal GLBi is at the high level regardless of the levels of the gate selection signals given to the nodes 812 to 814, and thus the first switch SW1 in the corresponding pixel circuit 500 (FIG. 3) turns off. When the gate enable signal given to the node 811 is at the high level, an operation is performed depending on the levels of the gate selection signals given to the nodes 812 to 814, as described below. When all of the gate selection signals given to the nodes 812 to 814 are at the high level, the scanning signal GLi is at the high level and the scanning signal GLBi at the low level, and thus the first switch in the corresponding pixel circuit 500 SW1 turns on. When at least one of the gate selection signals given to the nodes 812 to 814 is at the low level, the scanning signal GLi is at the low level and the scanning signal GLBi is at the high level, and thus the first switch SW1 in the corresponding pixel circuit 500 turns off.

As a result of the above-described operation of the gate driver 40, binary data corresponding to image data are written in memory circuits 520 in pixel circuits located in a row selected as a target row to which data signals are to be written in each horizontal scanning period.

1.4 Effects

According to the present embodiment, in the liquid crystal display device including the memory circuit 520 in the pixel circuit 500, four serial data SI1 to SI4 corresponding to image data are given to the interface unit 11 (see FIG. 1) via four serial data lines. In the liquid crystal display device, the four data conversion circuits 140*a*(1) to 140*a*(4) corresponding, in a one-to-one manner, to the four serial data SI1 to SI4 are provided for performing the serial-parallel conversion process on the serial data. These four data conversion circuits 140*a*(1) to 140*a*(4) are capable of performing the serial-parallel conversion process in parallel. That is, in accordance with one clock pulse of the serial clock SCLK, the serial-parallel conversion process can be performed in parallel on the four serial data SI1Z to SI4Z. This results in an increase in the number of pieces of serial data processed in response to one clock as compared with the conventional technique, and thus it becomes possible to increase the maximum number of pixels that can satisfy the specified screen rewriting frequency compared with the conventional technique. Furthermore, according to the present embodiment, it is possible to select, by using the serial data selection signal SEL_SI, whether to use one serial data line or four serial data lines. Therefore, it is possible to display an image even when serial data is transmitted using one serial data line as with the conventional technique, while in the case where serial data is transmitted using four serial data lines, the image can be displayed while rewriting (updating) the screen at a high speed.

2. Second Embodiment

A second embodiment is described below focusing on differences from the first embodiment.

2.1 Overall Configuration and Brief Description of Operation

Figure 26:
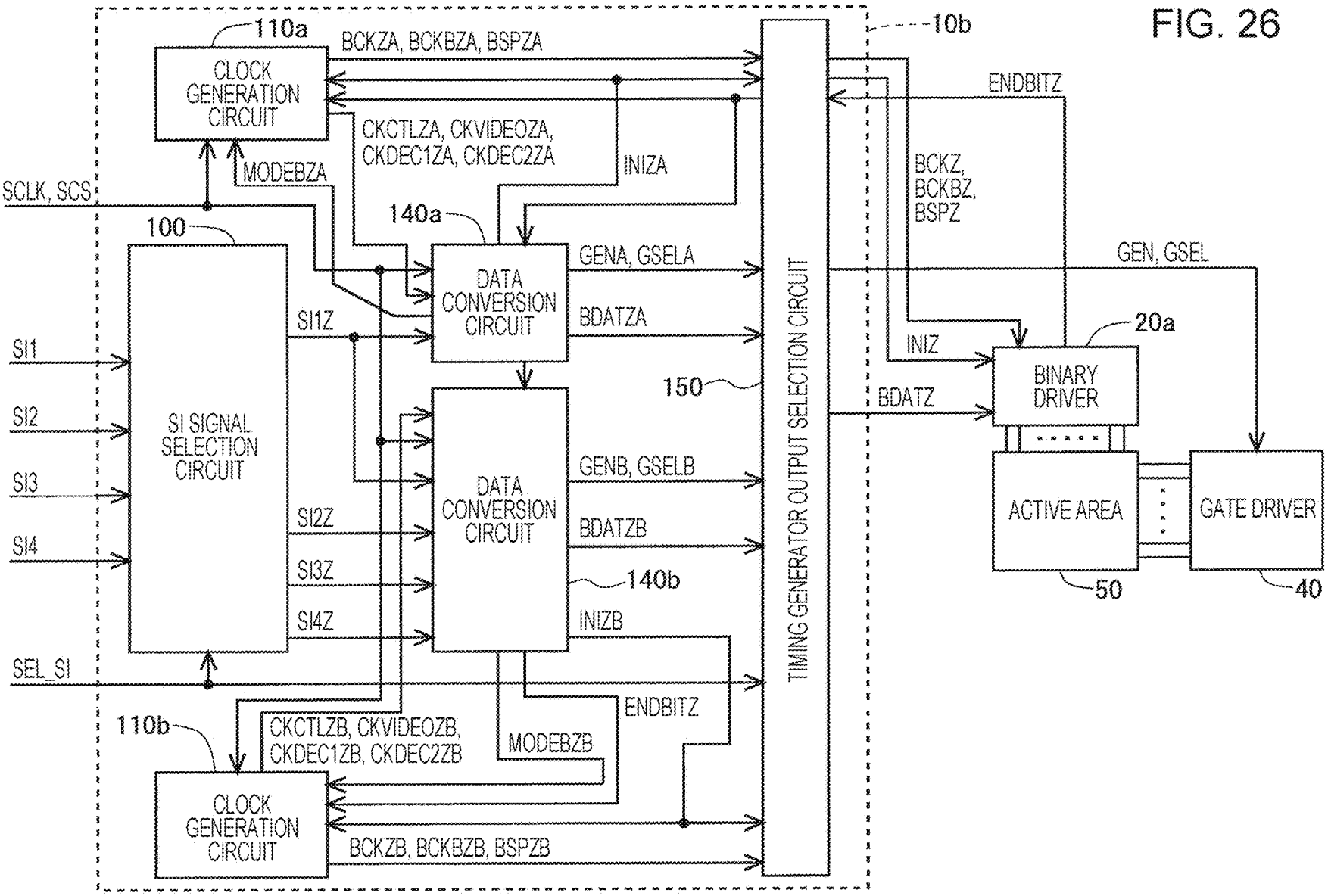
FIG. 26 is a block diagram illustrating an overall configuration of a liquid crystal display device according to a second embodiment.

FIG. 26 is a block diagram illustrating an overall configuration of a liquid crystal display device according to a second embodiment. As shown in FIG. 26, this liquid crystal display device includes a timing generator 10*b*, a binary driver 20*a*, a gate driver 40, and an active area 50. The timing generator 10*b* includes an SI signal selection circuit 100, a clock generation circuit 110*a*, a clock generation circuit 110*b*, a data conversion circuit 140*a*, a data conversion circuit 140*b*, and a timing generator output selection circuit 150.

Also in the present embodiment, the serial data SI1 to SI4, the serial data selection signal SEL_SI, the serial clock SCLK, and the serial chip select signal SCS are externally supplied to the timing generator via an interface unit 11 (see FIG. 1). Furthermore, also in the present embodiment, four serial data lines are provided.

The timing generator 10*b* receives the serial data SI1 to SI4, the serial data selection signal SEL_SI, the serial clock SCLK, the serial chip select signal SCS, and a control signal ENDBITZ, and outputs a gate enable signal GEN, a gate selection signal GSEL, a control signal BCKZ, a control signal BCKBZ, a control signal BSPZ, a control signal INIZ, and binary data BDATZ. The binary data BDATZ includes eight pieces of 1-bit data.

The SI signal selection circuit 100 in the timing generator 10*b* operates in a similar manner to the first embodiment.

The clock generation circuit 110*a* in the timing generator 10*b* operates in a similar manner as in the first embodiment. In FIG. 26, in order to distinguish input/output signals of the clock generation circuit 110*a* and input/output signals of the clock generation circuit 110*b*, a suffix "A" is added to the end of a symbol denoting each input/output signal of the clock generation circuit 110*a* except for the serial clock SCLK and the control signal ENDBITZ. For example, in FIG. 26, a control signal BCKZA corresponds to the control signal BCKZ according to the first embodiment.

The data conversion circuit 140*a* in the timing generator 10*b* operates in a similar manner to the data conversion circuit 140*a*(1) according to the first embodiment. Note that in FIG. 26 in order to distinguish between output signals from the data conversion circuit 140*a* and output signals from the data conversion circuit 140*b*, a suffix "A" is added to the end of each of the symbols denoting the output signals from the data conversion circuit 140*a*.

The clock generation circuit 110*b* in the timing generator 10*b* receives the serial clock SCLK, a control signal MODEBZB, a control signal ENDBITZ, and a control signal INIZB, and outputs a control signal BCKZB, a control signal BCKBZB, a control signal BSPZB, a control signal CKCTLZB, a control signal CKVIDEOZB, a control signal CKDEC1ZB and a control signal CKDEC2ZB.

The data conversion circuit 140*b* in the timing generator 10*b* receives the serial clock SCLK, the serial chip select signal SCS, the serial data SI1Z to SI4Z, the control signal CKCTLZB, the control signal CKVIDEOZB, the control signal CKDEC1ZB, the control signal CKDEC2ZB, and the control signal ENDBITZ, and outputs a control signal INIZB, a control signal MODEBZB, a gate enable signal GENB, a gate selection signal GSELB, and binary data BDATZB.

The timing generator output selection circuit 150 in the timing generator 10*b* receives the control signal BCKZA, the control signal BCKBZA, the control signal BSPZA, the control signal INIZA, the gate enable signal GENA, the gate selection signal GSELA, the binary data BDATZA, the control signal BCKZB, the control signal BCKBZB, the control signal BSPZB, the control signal INIZB, the gate enable signal GENB, the gate selection signal GSELB, the binary data BDATZB, and the serial data selection signal SEL_SI, and outputs a control signal BCKZ, a control signal BCKBZ, a control signal BSPZ, a control signal INIZ, a gate enable signal GEN, a gate selection signal GSEL, and binary data BDATZ. In the present embodiment, when the serial data selection signal SEL_SI is at the high level, the control signal BCKZA, the control signal BCKBZA, the control signal BSPZA, the control signal INIZA, the gate enable signal GENA, the gate selection signal GSELA, and the binary data BDATZA are respectively output as the control signal BCKZ, the control signal BCKBZ, the control signal BSPZ, the control signal INIZ, the gate enable signal GEN, the gate selection signal GSEL, and the binary data BDATZ. When the serial data selection signal SEL_SI is at the low level, the control signal BCKZB, the control signal BCKBZB, the control signal BSPZB, the control signal INIZB, the gate enable signal GENB, the gate selection signal GSELB, and the binary data BDATZB are respectively outputs as the control signal BCKZ, the control signal BCKBZ, the control signal BSPZ, the control signal INIZ, the gate enable signal GEN, the gate selection signal GSEL, and the binary data BDATZ.

The binary driver 20*a* operates in a similar manner as in the first embodiment. Note that the binary data BDATZ in FIG. 26 corresponds to the binary data BDAT1Z in FIG. 2. The gate driver 40 also operates in a similar manner as in the first embodiment.

In the present embodiment, the data conversion circuits 140*a* and 140*b* implement a serial data conversion circuit, the binary driver 20*a* and the gate driver 40 implement a display drive circuit, and the timing generator output selection circuit 150 implements a supply switching circuit. Furthermore, the data conversion circuit 140*a* implements the first data conversion circuit, the data conversion circuit 140*b* implements the second data conversion circuit, the clock generation circuit 110*a* implements the first clock signal generation circuit, and the clock generation circuit 110*b* implements the second clock signal generation circuit. Furthermore, the timing control clock signal group used in the case where the processing target data captured by the serial data selection circuit (the SI signal selection circuit 100) is one piece of serial data is implemented by the control signal BCKZA, the control signal BCKBZA, the control signal BSPZA, the control signal CKCTLZA, the control signal CKVIDEOZA, the control signal CKDEC1ZA, and the control signal CKDEC2ZA, while the timing control clock signal group used in the case where the processing target data captured by the serial data selection circuit (the SI signal election circuit 100) is a plurality of pieces of serial data is implemented by the control signal BCKZB, the control signal BCKBZB, the control signal BSPZB, the control signal CKCTLZB, the control signal CKVIDEOZB, the control signal CKDEC1ZB, and the control signal CKDEC2ZB.

Note that the clock generation circuit 110*a* and the data conversion circuit 140*a* function as components when one serial data line is used, while the clock generation circuit 110*b* and the data conversion circuit 140*b* function as components when four serial data lines are used.

2.2 Detailed Configuration and Operation of Each Component

Figure 27:
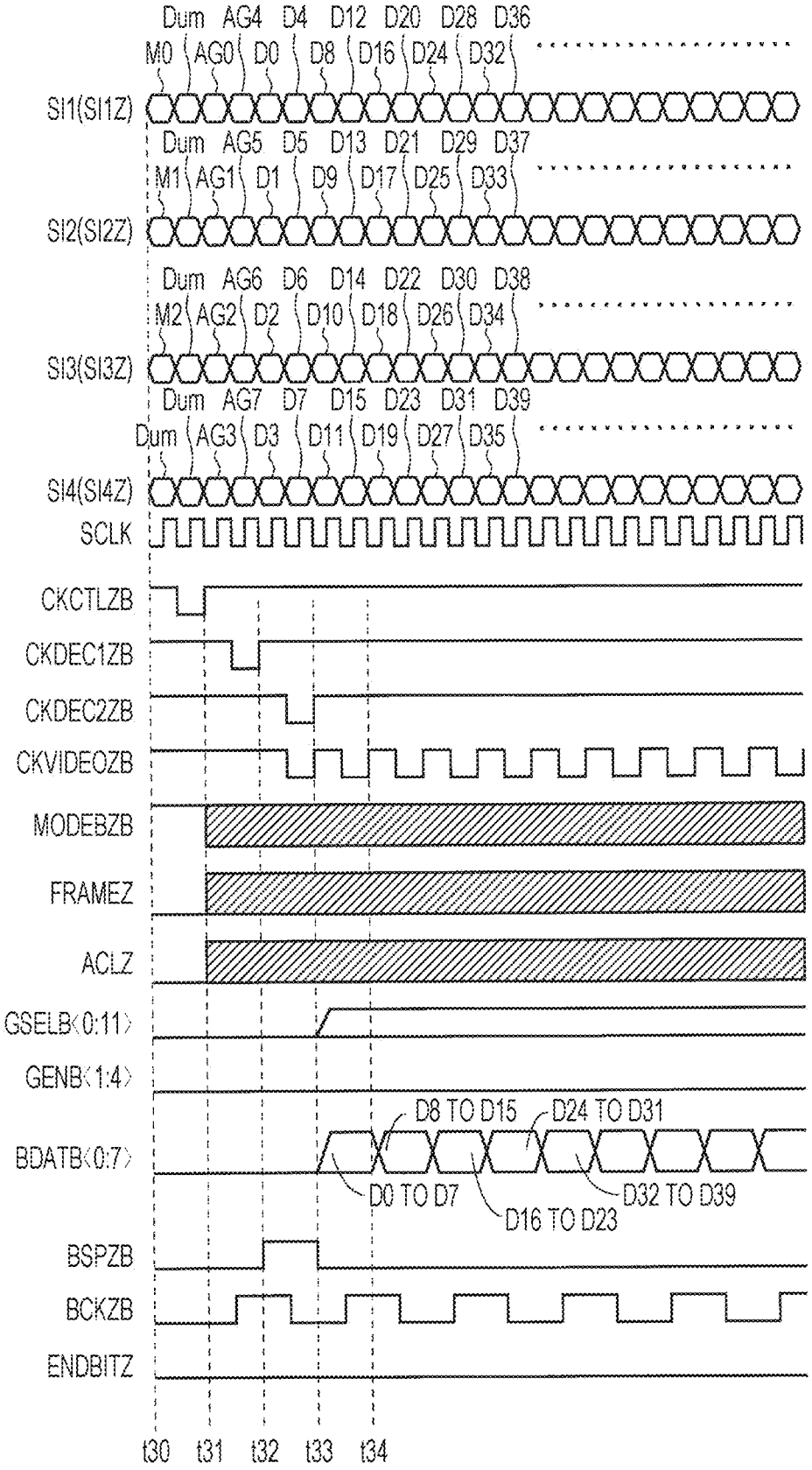
FIG. 27 is a signal waveform diagram illustrating signal waveforms around the start of a frame period in a state in which a serial data selection signal is set at a low level according to the second embodiment.
Figure 28:
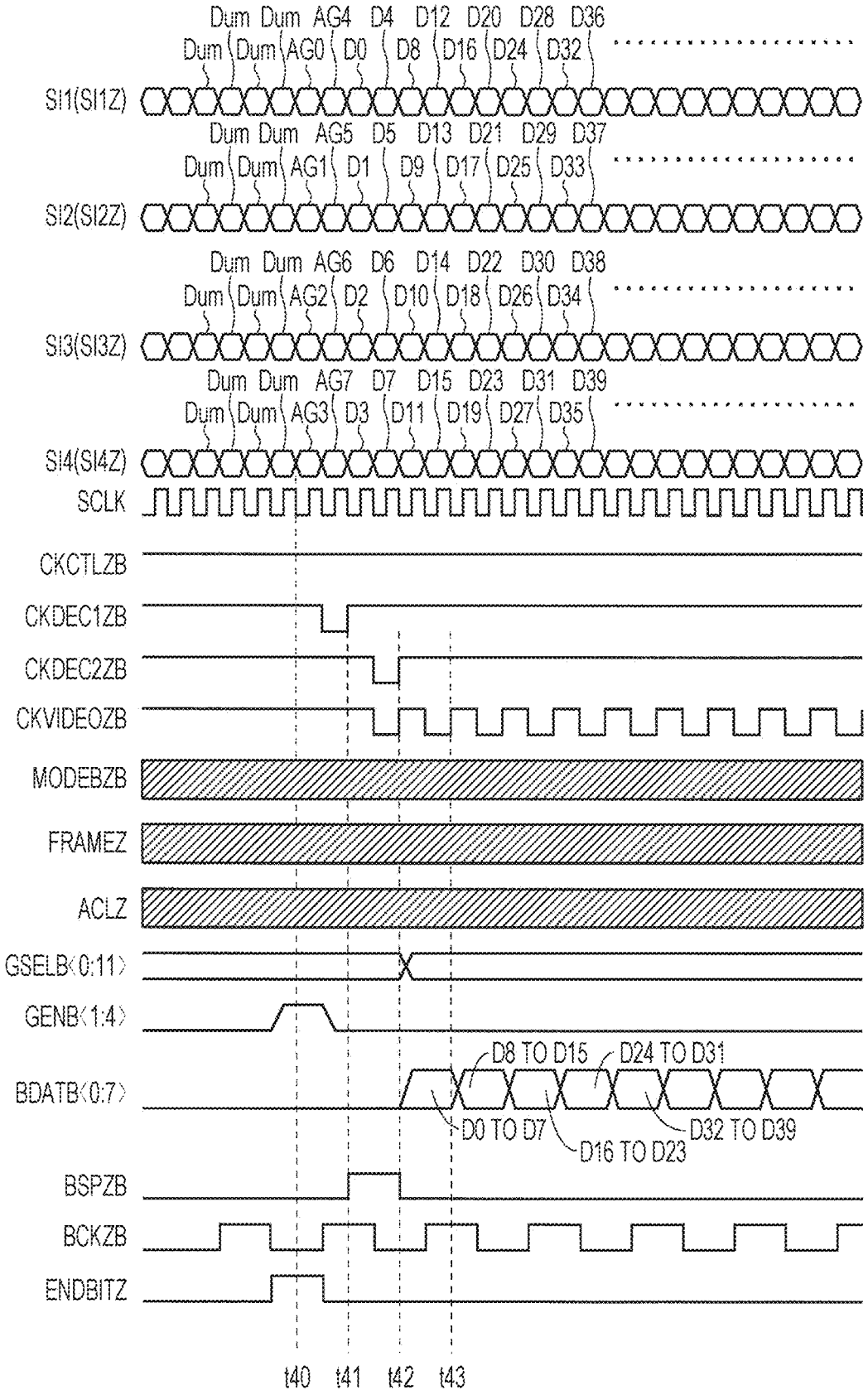
FIG. 28 is a signal waveform diagram illustrating signal waveforms corresponding to a row other than the first row in a period around the start of a horizontal scanning period in the state in which the serial data selection signal is at the low level according to the second embodiment.

The detailed configuration and operation of each component shown in FIG. 26 are described below. Note that the signal waveform diagrams shown in FIG. 27 and FIG. 28 are referred to, as appropriate. FIG. 27 and FIG. 28 are signal waveform diagrams for explaining the operation of the clock generation circuit 110*b* and the data conversion circuit 140*b* when the serial data selection signal SEL_SI is set to the low level (such that four serial data lines are used). FIG. 27 is a signal waveform diagram around the start of a frame period (around the start of a horizontal scanning period corresponding to a first row). FIG. 28 is a signal waveform diagram around the start of a horizontal scanning period corresponding to a row other than the first row.

In the present embodiment, the flag data M0 is included in the serial data SI1, the flag data M1 is included in the serial data SI2, and the flag data M2 is included in the serial data SI3. Regarding the gate address data, the gate address data AG0 and AG4 are included in the serial data SI1, the gate address data AG1 and AG5 are included in the serial data SI2, the gate address data AG2 and AG6 are included in the serial data SI3, and the gate address data AG3 and AG7 are included in the serial data SI4. Also in the present embodiment, one row is identified by a combination of eight pieces of gate address data AG0 to AG7.

2.2.1 Clock Generation Circuit

Figure 29:
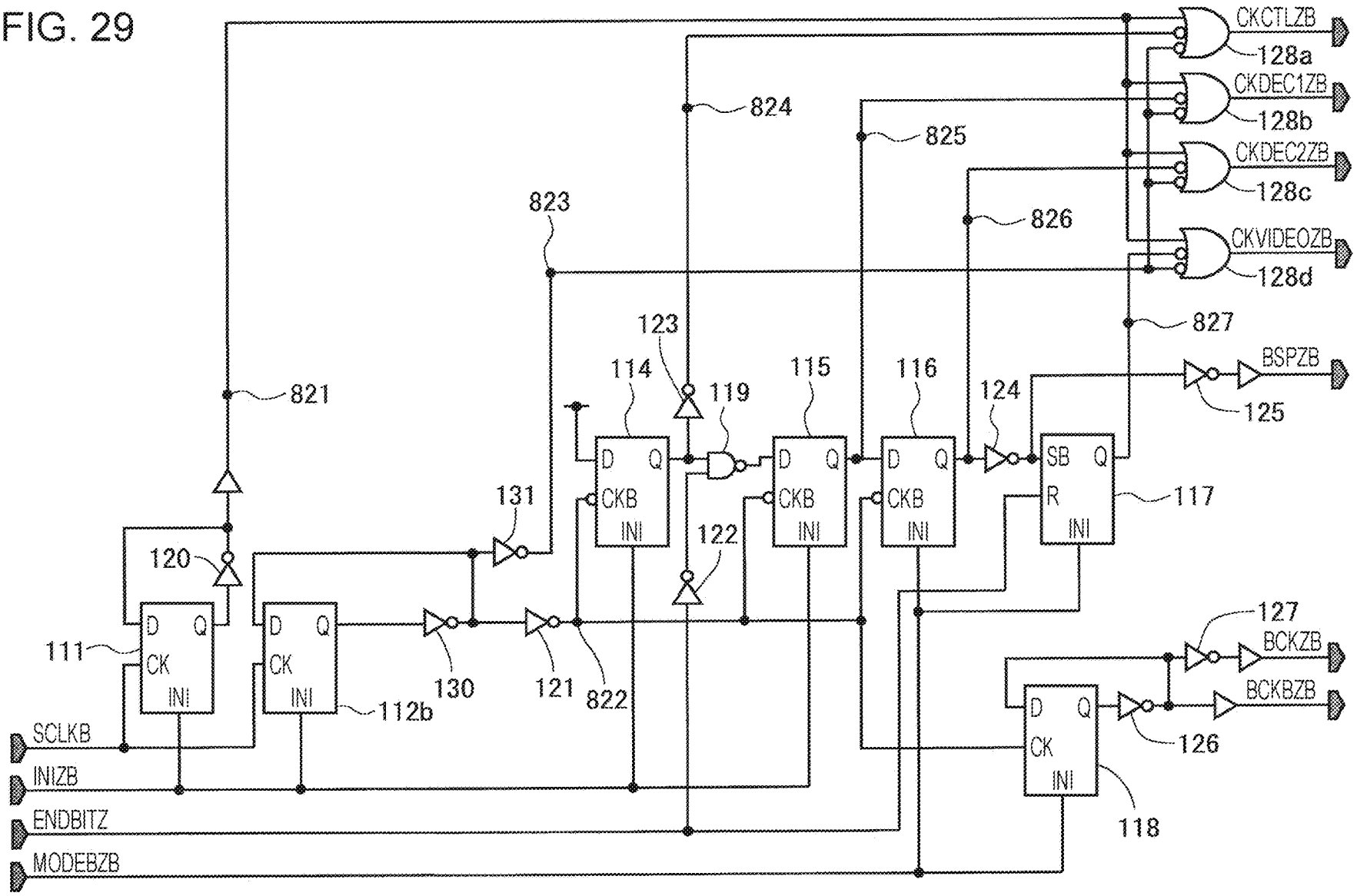
FIG. 29 is a circuit diagram showing a detailed configuration of a clock generation circuit for use in a case where four serial data lines are used according to the second embodiment.

FIG. 29 is a circuit diagram illustrating a detailed configuration of the clock generation circuit 110*b*. As shown in FIG. 29, the clock generation circuit 110*b* includes a D flip-flop 111, a D flip-flop 112*b*, a D flip-flop 114, a D flip-flop 115, a D flip-flop 116, a flip-flop circuit 117, a D flip-flop 118, a NAND circuit 119, inverters 120 to 127, 130, and 131, OR circuits 128*a* to 128*d*, and a plurality of buffers. As can be seen from FIG. 7 and FIG. 29, in the clock generation circuit 110*b*, the D flip-flop 112*b*, the inverter 130, and the inverter 131 are provided instead of the circuit unit 112 and the NOR circuit 113 provided in the clock generation circuit 110*a*.

In the configuration described above, the potential of a node 821 is switched between the high level and the low level every clock of the serial clock SCLK as with the potential V(801) (see FIG. 9) of the node 801 in FIG. 7. Regarding the potential of a node 822, when the potential of the node 821 is at the high level, the potential of the node 822 is at the low level, while when the potential of the node 821 is at the low level, the potential of the node 822 is at the high level. The potential of a node 823 changes in a similar manner to the potential of the node 822. The potential of a node 824 is at the high level only for a particular period in the beginning of each frame period as with the potential of the node 804 shown in FIG. 7. The potential of a node 825 goes to the high level when a period of two clocks of the serial clock SCLK elapses since the potential of the node 824 goes to the high level. The potential of a node 826 goes to the high level when a period of two clocks of the serial clock SCLK elapses since the potential of the node 825 goes to the high level. Regarding the potential of a node 827, after the output from the inverter 124 changes from the high level to the low level in each horizontal scanning period (after the control signal BSPZB changes from the low level to the high level in each horizontal scanning period), the potential of the node 827 is maintained at the high level over a period thereafter in the horizontal scanning period. The OR circuits 128*a* to 128*d* are configured in a similar manner as in the first embodiment.

Thus, waveforms of the control signal CKCTLZB, the control signal CKDEC1ZB, the control signal CKDEC2ZB, the control signal CKVIDEOZB, the control signal BSPZB, and the control signal BCKZB output from the clock generation circuit 110*b* are as shown in FIG. 27 and FIG. 28.

Frequencies of various control signals generated by the clock generation circuit 110*b* are four times the frequencies of various control signals generated by the clock generation circuit 110*a* (see FIG. 4 and FIG. 5).

2.2.2 Data Conversion Circuit

Figure 30:
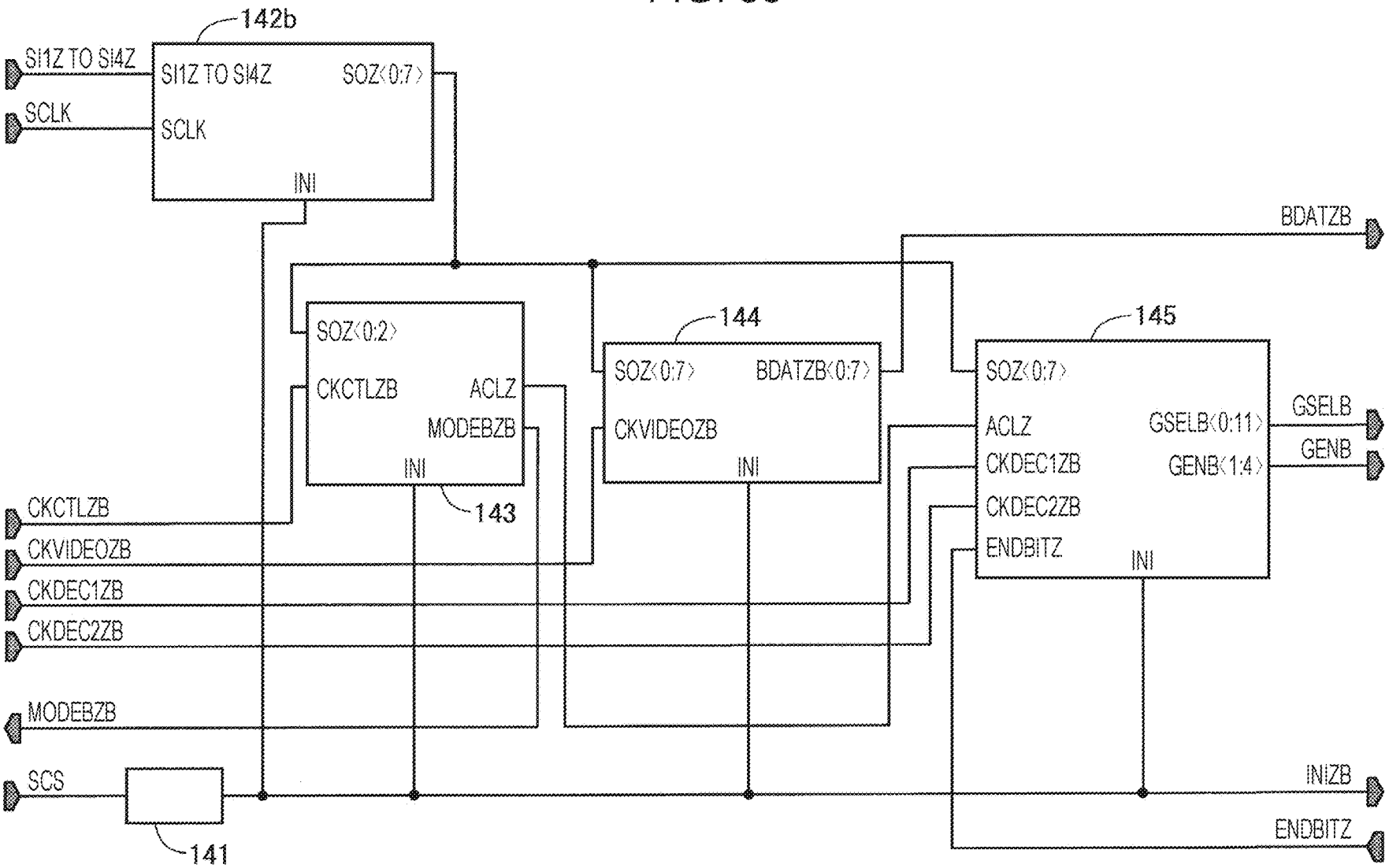
FIG. 30 is a circuit diagram showing a detailed configuration of a data conversion circuit for use in the case where four serial data lines are used according to the second embodiment.

FIG. 30 is a block diagram illustrating a configuration of the data conversion circuit 140*b*. In the data conversion circuit 140*b*, instead of the serial-parallel conversion circuit 142 shown in FIG. 13, a serial-parallel conversion circuit 142*b* is provided. The serial-parallel conversion circuit 142*b* is supplied with the serial clock SCLK and the control signal INI, and also with four pieces of serial data SI1Z to SI4Z in parallel.

Figure 31:
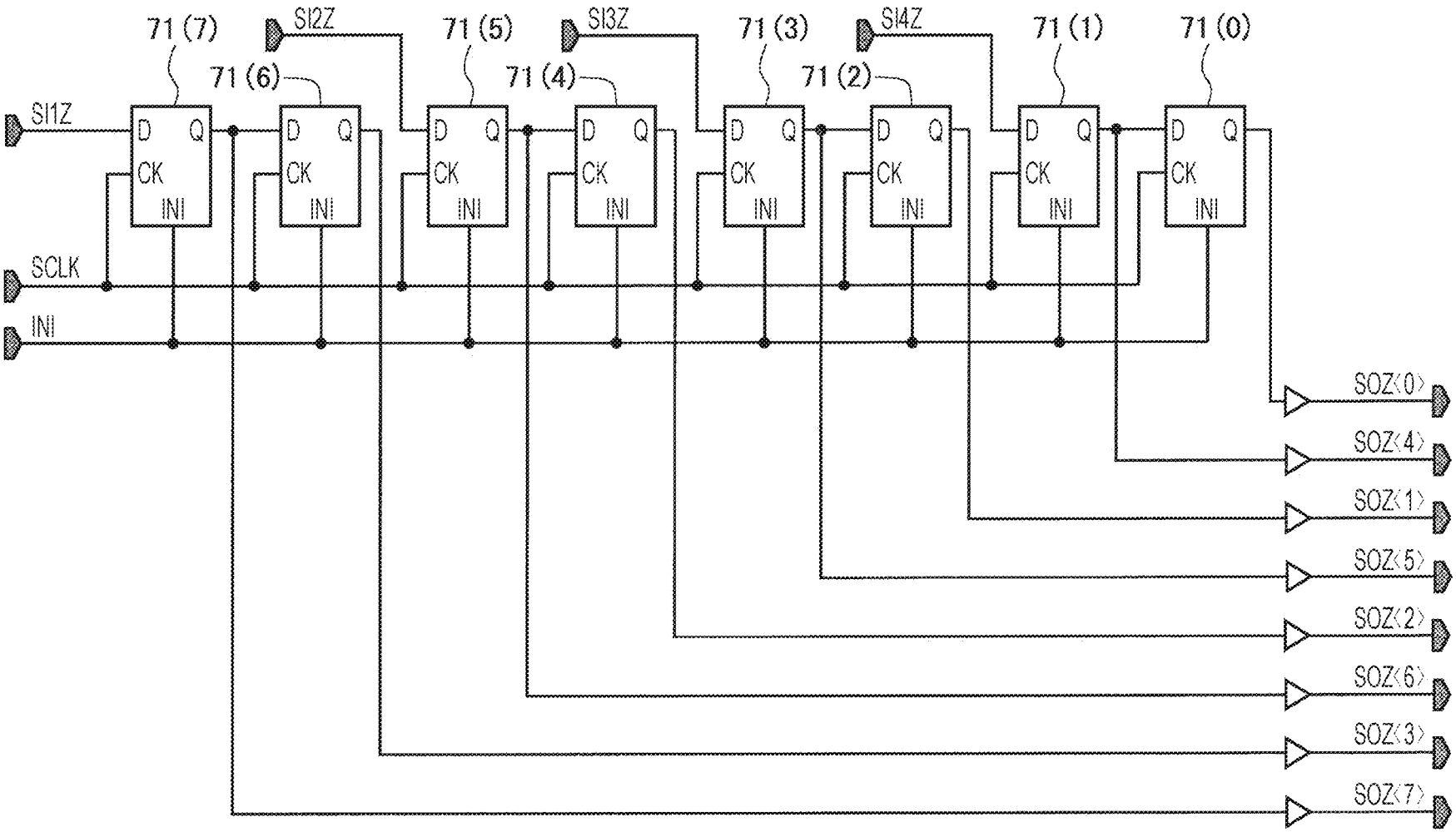
FIG. 31 is a circuit diagram showing a detailed configuration of a serial-parallel conversion circuit in a data conversion circuit for use in the case where four serial data lines are used according to the second embodiment.

FIG. 31 is a circuit diagram illustrating a detailed configuration of the serial-parallel conversion circuit 142*b*. The serial-parallel conversion circuit 142*b* includes eight D flip-flops 71(0) to 71(7) and eight buffers. The serial data SI1Z is given to a D input terminal of the D flip-flop 71(7), and an output from a Q output terminal of the D flip-flop 71(7) is given to a D input terminal of the D flip-flop 71(6). The serial data SI2Z is given to a D input terminal of the D flip-flop 71(5), and an output from a Q output terminal of the D flip-flop 71(5) is given to a D input terminal of the D flip-flop 71(4). The serial data SI3Z is given to a D input terminal of the D flip-flop 71(3), and an output from a Q output terminal of the D flip-flop 71(3) is given to a D input terminal of the D flip-flop 71(2). The serial data SI4Z is given to a D input terminal of the D flip-flop 71(1), and an output from a Q output terminal of the D flip-flop 71(1) is given to a D input terminal of the D flip-flop 71(0). Data from the Q output terminals of D flip-flops 71(0), 71(1), 71(2), 71(3), 71(4), 71(5), 71(6), and 71(7) are respectively output as parallel data SOZ<0>, SOZ<4>, SOZ<1>, SOZ<5>, SOZ<2>, SOZ<6>, SOZ<3>, and SOZ<7> from the serial-parallel conversion circuit 142*b*.

As can be seen from FIG. 27, at the beginning of each frame period, the serial-parallel conversion circuit 142*b* receives the flag data M0 as the serial data SI1Z, the flag data M1 as the serial data SI2, the flag data M2 as the serial data SI3Z, and the dummy data Dum as the serial data SI4Z. As a result, the flag data M0 is output as parallel data SOZ<3>, the flag data M1 is output as parallel data SOZ<2>, and the flag data M2 is output as parallel data SOZ<1>. Next, at the beginning of each horizontal scanning period, the serial-parallel conversion circuit 142*b* receives the gate address data AG0 and AG4 as serial data SI1Z to the serial-parallel conversion circuit 142*b*, the gate address data AG1 and AG5 as serial data SI2Z, the gate address data AG2 and AG6 as serial data SI3Z, and the gate address data AG3 and AG7 as serial data SI4Z. As a result, the gate address data AG0 is output as parallel data SOZ<3>, the gate address data AG4 is output as parallel data SOZ<7>, the gate address data AG1 is output as parallel data SOZ<2>, the gate address data AG5 is output as parallel data SOZ<6>, the gate address data AG2 is output as parallel data SOZ<1>, the gate address data AG6 is output as parallel data SOZ<5>, the gate address data AG3 is output as parallel data SOZ<0>, and the gate address data AG7 is output as parallel data SOZ<4>. After that, image data is given as the serial data SI1Z to SI4Z to the serial-parallel conversion circuit 142*b*. As a result, the image data input as the serial data SI1Z to SI4Z to the serial-parallel conversion circuit 142*b* are output as the parallel data SOZ<0> to SOZ<7> from the serial-parallel conversion circuit 142*b*.

In the serial-parallel conversion circuit 142 shown in FIG. 14, when eight clock pulses of the serial clock SCLK are input after certain serial data SIZ is input, the parallel data SOZ<0> to SOZ<7> become valid. In contrast, in the serial-parallel conversion circuit 142*b*, when two clock pulses of the serial clock SCLK are input after certain serial data SI1Z to SI4Z are input, the parallel data SOZ<0> to SOZ<7> become valid. Thus, the serial-parallel conversion circuit 142*b* operates four times faster than the serial-parallel conversion circuit 142. That is, in the serial-parallel conversion circuit 142*b*, the number of pieces of serial data that can be processed in one clock is four times that of the serial-parallel conversion circuit 142.

2.2.3 Timing Generator Output Selection Circuit

Figure 32:
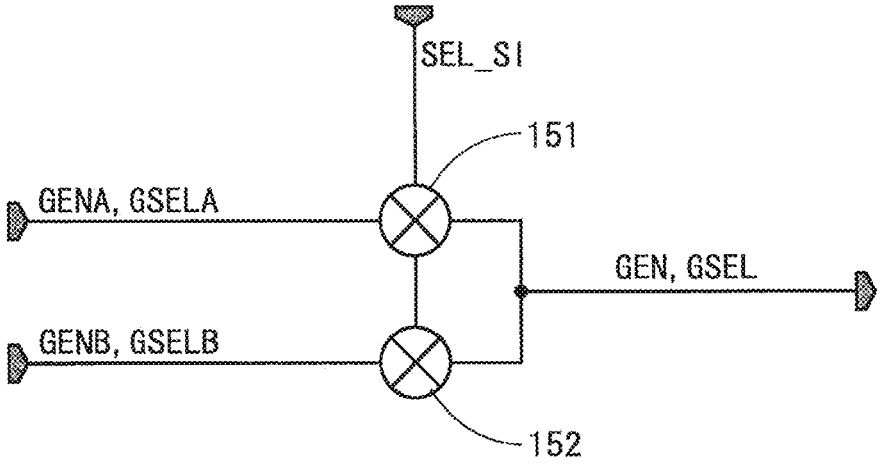
FIG. 32 is a schematic circuit diagram showing a configuration of part of a timing generator output selection circuit according to the second embodiment.

FIG. 32 is a schematic circuit diagram illustrating a partial configuration of the timing generator output selection circuit 150. As shown in FIG. 32, the timing generator output selection circuit 150 includes switches 151 and 152 whose states are controlled by the serial data selection signal SEL_SI. When the serial data selection signal SEL_SI is at the high level, the switch 151 is in the on-state and the switch 152 is in the off-state. When the serial data selection signal SEL_SI is at the low level, the switch 151 is in the off-state and the switch 152 is in the on-state.

Thus, when the serial data selection signal SEL_SI is at the high level, the gate enable signal GENA supplied from the data conversion circuit 140*a* is output as a gate enable signal GEN, and the gate selection signal GSELA supplied from the data conversion circuit 140*a* is output as a gate selection signal GSEL. When the serial data selection signal SEL_SI is at the low level, the gate enable signal GENB given from the data conversion circuit 140*b* is output as the gate enable signal GEN, and the gate selection signal GSELB given from the data conversion circuit 140*b* is output as the gate selection signal GSEL.

Similarly, depending on the serial data selection signal SEL_SI, the combination of the control signal BCKZA, the control signal BCKBZA, the control signal BSPZA, the control signal INIZA, and the binary data BDATZA or the combination of the control signal BCKZB, the control signal BCKBZB, the control signal BSPZB, the control signal INIZB, and the binary data BDATZB is output as the control signal BCKZ, the control signal BCKBZ, the control signal BSPZ, the control signal INIZ, and the binary data BDATZ from the timing generator output selection circuit 150.

The gate enable signal GENA includes four signals, and the gate selection signal GSELA includes twelve signals. Therefore, the switch 151 shown in FIG. 32 actually includes twelve switches. Similarly, the switch 152 shown in FIG. 32 actually includes twelve switches.

2.3 Effects

According to the present embodiment, in the liquid crystal display device including the memory circuit 520 in the pixel circuit 500, four serial data SU to SI4 corresponding to image data are given to the interface unit 11 (see FIG. 1) via four serial data lines. The liquid crystal display device includes the clock generation circuit 110*a* that generates control signals in the case where one serial data line is used, and the clock generation circuit 110*b* that generates control signals in the case where four serial data lines are used. The frequency of the control signals generated by the clock generation circuit 110*b* is four times the frequency of the control signals generated by the clock generation circuit 110*a*. Furthermore, the liquid crystal display device includes the data conversion circuit 140*a* that performs the serial-parallel conversion process on one pieces of serial data SI1Z and the data conversion circuit 140*b* that performs the serial-parallel conversion process on four pieces of serial data SI1Z to SI4Z. The serial-parallel conversion circuit 142*b* in the data conversion circuit 140*b* operates four times faster than the serial-parallel conversion circuit 142 in the data conversion circuit 140*a*. The timing generator output selection circuit 150 switches the data supplied to the binary driver 20*a* and the gate driver 40 depending on whether one serial data line is used or four serial data lines are used. In the above operation, when four serial data lines are used, the number of pieces of serial data that can be processed in one clock is four times greater than when one serial data line is used as in the conventional technique. Thus, use of the four serial data lines makes it possible to increase the maximum number of pixels that can satisfy the specification in terms of the screen rewriting frequency as compared with the conventional technique. Furthermore, in the present embodiment, the binary driver 20*b* and the output selection circuits 30*a* and 30*b* provided in the first embodiment (see FIG. 2) may not be used, and the number of data conversion circuits used is smaller than in the first embodiment. Thus, it is possible to reduce the circuit area in the panel, and it becomes easy to realize a narrow frame.

Figure 33:
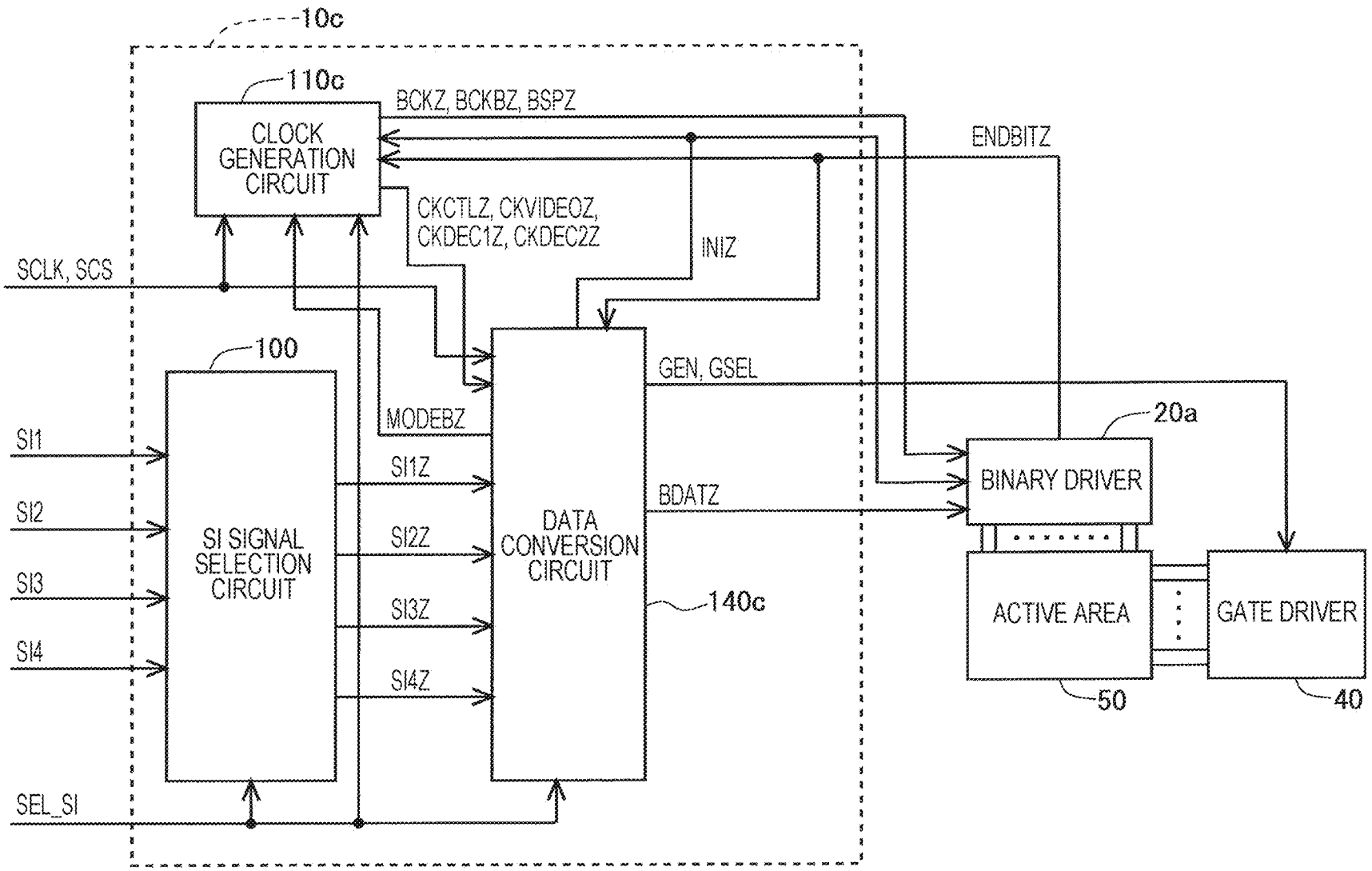
FIG. 33 is a block diagram illustrating an overall configuration of a liquid crystal display device according to a third embodiment.

3. Third Embodiment 3.1 Overall Configuration and Brief Description of Operation FIG. 33 is a block diagram illustrating an overall configuration of a liquid crystal display device according to a third embodiment. As shown in FIG. 33, this liquid crystal display device includes a timing generator 10*c*, a binary driver 20*a*, a gate driver 40, and an active area 50. The timing generator 10*c* includes an SI signal selection circuit 100, a clock generation circuit 110*c*, and a data conversion circuit 140*c*.

Also in the present embodiment, the serial data SI1 to SI4, the serial data selection signal SEL_SI, the serial clock SCLK, and the serial chip select signal SCS are externally supplied to the timing generator via an interface unit 11 (see FIG. 1). Furthermore, also in the present embodiment, four serial data lines are provided.

The timing generator 10*c* receives the serial data SI1 to SI4, the serial data selection signal SEL_SI, the serial clock SCLK, the serial chip select signal SCS, and the control signal ENDBITZ, and outputs a gate enable signal GEN, and a gate selection signal GSEL, a control signal BCKZ, a control signal BCKBZ, a control signal BSPZ, a control signal INIZ, and binary data BDATZ. The binary data BDATZ includes eight pieces of 1-bit data.

The SI signal selection circuit 100 in the timing generator 10*c* operates in a similar manner to the first embodiment. Note that the clock generation circuit 110*c* and the data conversion circuit 140*c* in the timing generator 10*c* will be described later.

In the present embodiment, the data conversion circuit 140*c* implements a serial data conversion circuit, the clock generation circuit 110*c* implements a clock signal group generation circuit, and the binary driver 20*a* and the gate driver 40 implement a display drive circuit. A timing control clock signal group is formed so as to include the control signal BCKZ, the control signal BCKBZ, the control signal BSPZ, the control signal CKCTLZ, the control signal CKVIDEOZ, the control signal CKDEC1Z, and the control signal CKDEC2Z.

3.2 Clock Generation Circuit

Figure 34:
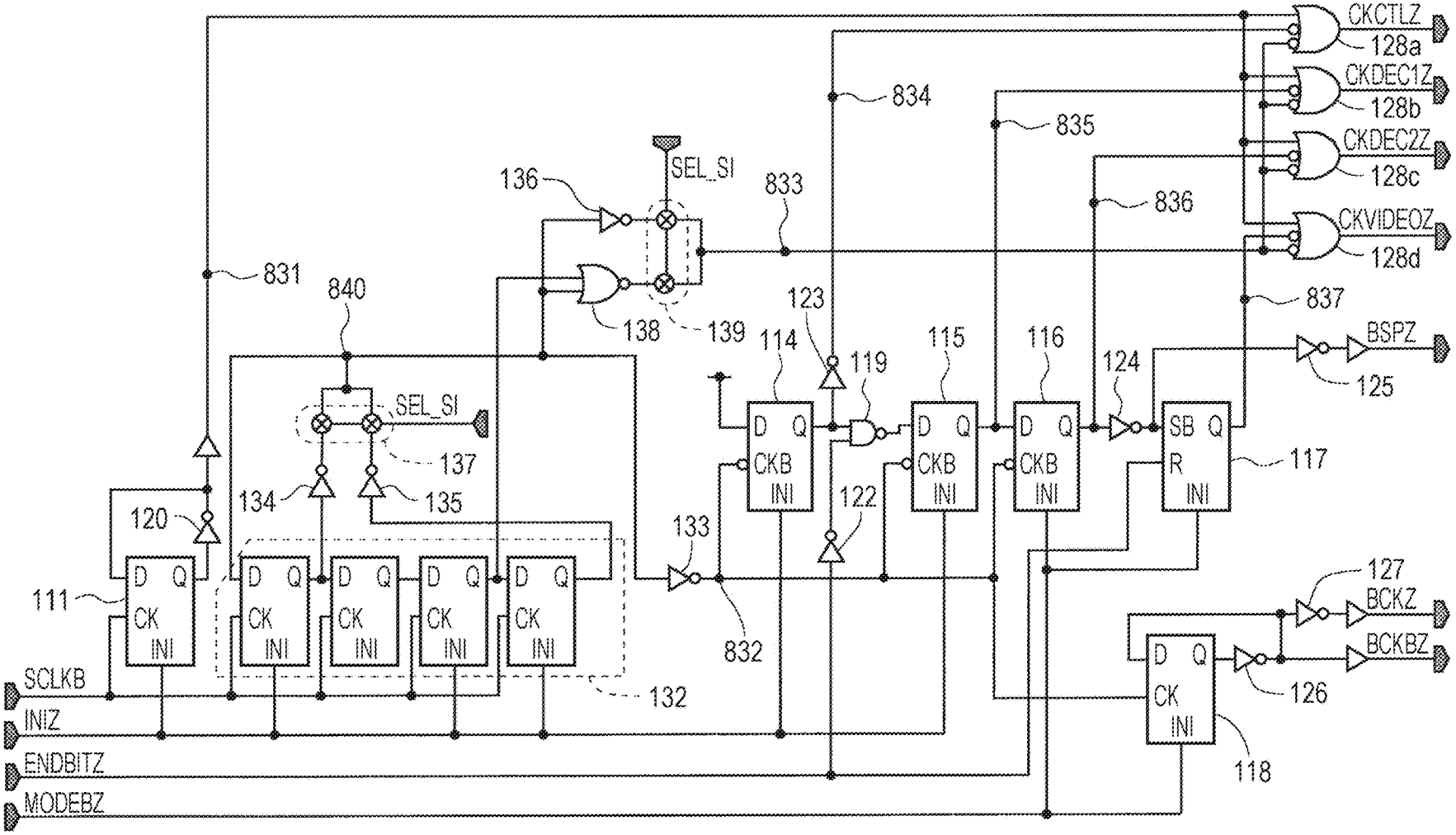
FIG. 34 is a circuit diagram illustrating a detailed configuration of a clock generation circuit according to the third embodiment.

FIG. 34 is a circuit diagram illustrating a detailed configuration of the clock generation circuit 110*c*. As shown in FIG. 34, the clock generation circuit 110*c* includes a D flip-flop 111, a circuit unit 132 including four D flip-flops, a D flip-flop 114, a D flip-flop 115, a D flip-flop 116, a flip-flop circuit 117, a D flip-flop 118, a NAND circuit 119, an inverter 120, inverters 122 to 127, and inverters 133 to 136, a switch unit 137 including two switches, a NOR circuit 138, a switch unit 139 including two switches, OR circuits 128*a* to 128*d*, and a plurality of buffers.

The switch unit 137 performs an operation as described below. When the serial data selection signal SEL_SI is at the high level, an output from the inverter 135 is given to a node 840, while when the serial data selection signal SEL_SI is at the low level, an output from the inverter 134 is given to the node 840. The switch unit 139 performs an operation as described below. When the serial data selection signal SEL_SI is at the high level, an output from the NOR circuit 138 is given to a node 833, while when the serial data selection signal SEL_SI is at the low level, an output from the inverter 136 is given to the node 833.

In the configuration described above, the potential of a node 831 is switched between the high level and the low level every clock of the serial clock SCLK as with the potential V(801) (see FIG. 9) of the node 801 in FIG. 7. The potential of the node 832 changes as follows. When the serial data selection signal SEL_SI is at the high level, the potential of the node 832 is switched between the high level and the low level every four clocks of the serial clock SCLK as with the potential V(802) (see FIG. 10) of the node 802 in FIG. 7. When the serial data selection signal SEL_SI is at the low level, as with the potential of the node 822 in FIG. 29, if the potential of the node 831 is at the high level then the potential of the node 832 is at the low level, but if the potential of the node 831 is at the low level, then the potential of the node 832 is at the high level. The potential of the node 833 changes as follows. When the serial data selection signal SEL_SI is at the high level, as with the potential V(803) (see FIG. 11) of the node 803 in FIG. 7, the potential of the node 833 is at the high level for a period of one clock of the serial clock SCLK every 8 clocks of the serial clock SCLK. When the serial data selection signal SEL_SI is at the low level, as with the potential of the node 823 in FIG. 29, if the potential of the node 831 is at the high level then the potential of the node 833 is at the low level, but if the potential of the node 831 is at the low level, then the potential of the node 833 is at the high level.

The potential of the node 834 is at the high level only for the predetermined period at the beginning of each frame period. The potential of the node 835 changes as follows. When the serial data selection signal SEL_SI is at the high level, as with the potential of the node 805 in FIG. 7, the potential of the node 835 goes to the high level when a period of 8 clocks of the serial clock SCLK elapses since the potential of the node 834 goes to the high level. When the serial data selection signal SEL_SI is at the low level, as with the potential of the node 825 in FIG. 29, the potential of the node 835 goes to the high level when a period of 2 clocks of the serial clock SCLK elapses since the potential of the node 834 goes to the high level. The potential at node 836 changes as follows. When the serial data selection signal SEL_SI is at the high level, as with the potential of the node 806 in FIG. 7, the potential of the node 836 goes to the high level when a period of 8 clocks of the serial clock SCLK elapses since the potential of the node 835 goes to the high level. When the serial data selection signal SEL_SI is at the low level, as with the potential of the node 826 in FIG. 29, the potential of the node 836 goes to the high level when a period of 2 clocks of the serial clock SCLK elapses since the potential of the node 835 goes to the high level. The potential of the node 837 changes as follows. When the serial data selection signal SEL_SI is at the high level, as with the potential of the note 807 in FIG. 7, if the output from the inverter 124 changes from the high level to the low level in each horizontal scanning period (when the control signal BSPZ changes from the low level to the high level in each scanning period), then over a period thereafter in the horizontal period the potential of the node 837 is maintained at the high level. When the serial data selection signal SEL_SI is at the low level, as with the potential of the note 827 in FIG. 29, if the output from the inverter 124 changes from the high level to the low level in each horizontal scanning period (when the control signal BSPZ changes from the low level to the high level in each scanning period), then over a period thereafter in the horizontal period the potential of the node 837 is maintained at the high level.

Thus, waveforms of the control signal CKCTLZ, the control signal CKDEC1Z, the control signal CKDEC2Z, the control signal CKVIDEOZ, the control signal BSPZ, and the control signal BCKZ, output from the clock generation circuit 110*c*, are as shown in FIG. 4 and FIG. 5 in the case where the serial data selection signal SEL_SI is at the high level, while the waveforms are as shown in FIG. 27 and FIG. 28 in the case where the serial data selection signal SEL_SI is at the low level (note that the control signals in FIG. 27 and FIG. 28 are denoted by adding a suffix "Z" to each signal name.). As described above, the clock generation circuit 110*c* generates various control signals depending on the level of the serial data selection signal SEL_SI (that is, depending on whether one serial data line is used or the four serial data lines are used). Note that the frequencies of various control signals used in the case where the four serial data lines are used are four times the frequencies of various control signals used in the case where the one serial data line is used.

3.3 Data Conversion Circuit

Figure 35:
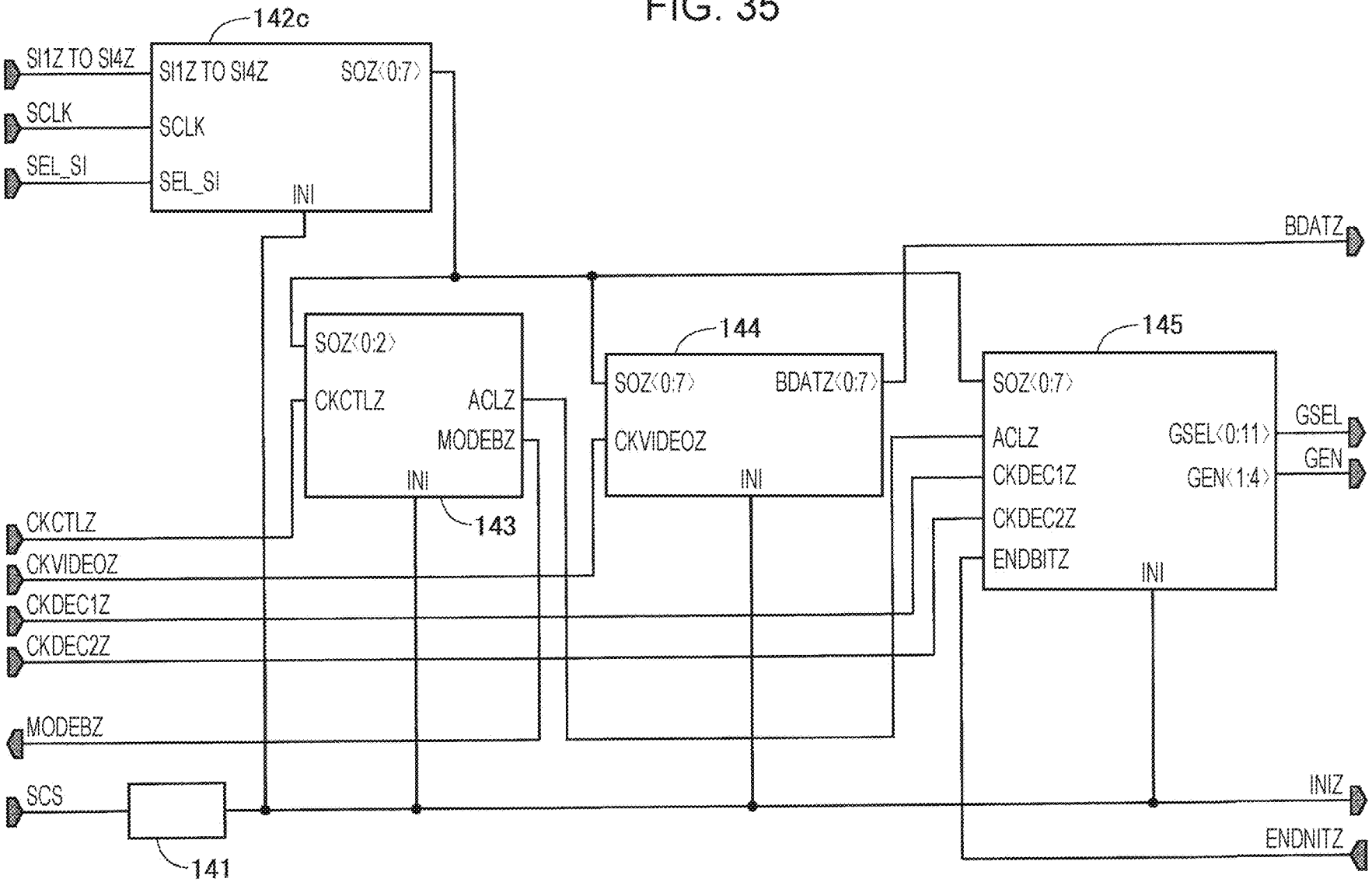
FIG. 35 is a block diagram illustrating a configuration of a data conversion circuit according to the third embodiment.

FIG. 35 is a block diagram illustrating a configuration of the data conversion circuit 140*c*. In the data conversion circuit 140*c*, a serial-parallel conversion circuit 142*c* is provided instead of the serial-parallel conversion circuit 142 in FIG. 13. The serial-parallel conversion circuit 142*c* receives the serial data selection signal SEL_SI, in addition to the serial data SI1Z to SI4Z, the serial clock SCLK, and the control signal INI. Note that the serial data SI1Z to SI4Z are input in parallel to the serial-parallel conversion circuit 142*c*.

Figure 36:
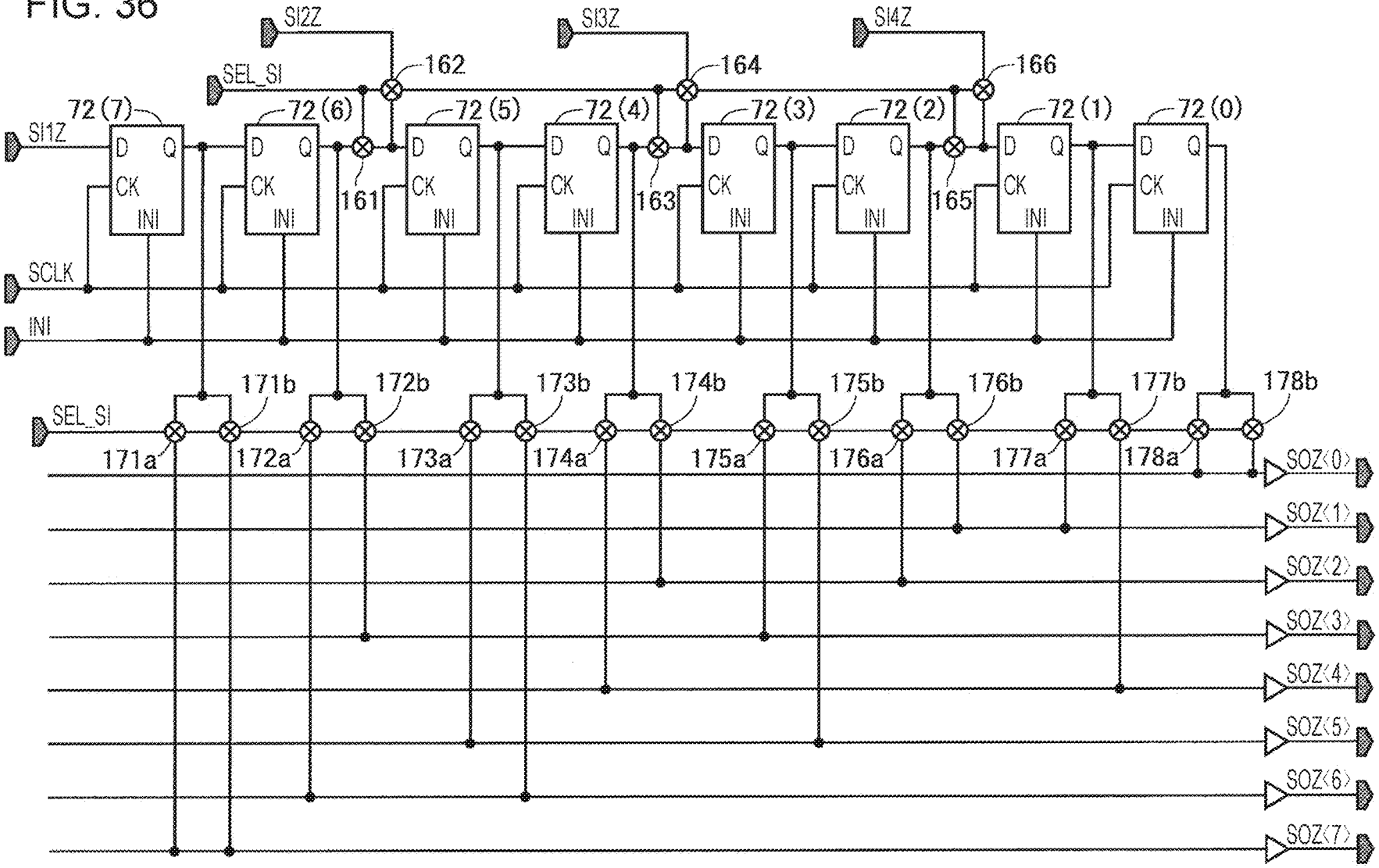
FIG. 36 is a circuit diagram illustrating a detailed configuration of a serial-parallel conversion circuit according to the third embodiment.

FIG. 36 is a circuit diagram illustrating a detailed configuration of the serial-parallel conversion circuit 142*c*. The serial-parallel conversion circuit 142*c* includes eight D flip-flops 72(0) to 72(7), twenty-two switches 161 to 166, 171*a* to 178*a*, and 171*b* to 178*b*, and eight buffers.

When the serial data selection signal SEL_SI is at the high level, the switches 161, 163, 165, and 171*a* to 178*a* turn on, and the switches 162, 164, 166, and 171*b* to 178*b* are turn off. As a result, the serial-parallel conversion circuit 142*c* performs an operation similar to the operation of the serial-parallel conversion circuit 142 shown in FIG. 14. When the serial data selection signal SEL_SI is at the low level, the switches 161, 163, 165, and 171*a* to 178*a* turn off, and the switches 162, 164, 166, and 171*b* to 178*b* turn on. As a result, the serial-parallel conversion circuit 142*c* performs an operation similar to the operation of the serial-parallel conversion circuit 142*b* shown in FIG. 31.

As a result of the above-described operation of the serial-parallel conversion circuit 142*c*, in the case where the serial data selection signal SEL_SI is at the high level, the parallel data SOZ<0> to SOZ<7> become valid when eight clock pulses of the serial clock SCLK are input after certain serial data SI1Z is input. On the other hand, in the case where the serial data selection signal SEL_SI is at the low level, the parallel data SOZ<0> to SOZ<7> become valid when two clock pulses of the serial clock SCLK are input after certain serial data SI1Z to SI4Z are input. As described above, in the case where the four serial data lines are used, the number of serial data processed in one clock by the serial-parallel conversion circuit 142*c* is four times larger than in the case where one serial data line is used.

As described above, the data conversion circuit 140*c*, outputs the binary data BDATZ given to the binary driver 20*a* and the gate enable signal GEN and the gate selection signal GSEL given to the gate driver 40 depending on the level of the serial data selection signal SEL_SI (that is, depending on whether the one serial data line is used or the four serial data lines are used).

3.4 Effects

According to the present embodiment, when four serial data lines are used, the clock generation circuit 110*c* generates a control signal having a frequency four times as high as when one serial data line is used. Furthermore, when four serial data lines area used, the number of pieces of serial data processed by the serial-parallel conversion circuit 142*c* at a time in response to one clock is four times as large as when one serial data line is used. As described above, use of the four serial data lines makes it possible to increase the maximum number of pixels that can satisfy the specification in terms of the screen rewriting frequency as compared with the conventional technique. Furthermore, in the present embodiment, in contrast to the second embodiment in which two clock generation circuits and two data conversion circuits are provided in the timing generator 10*b* (see FIG. 26), only one clock generator circuit and one data conversion circuit are provided in the timing generator 10*c*. Furthermore, in the present embodiment, the binary driver 20*b* and the output selection circuits 30*a* and 30*b* provided in the first embodiment may not be used. Thus, the present embodiment makes it possible to reduce the circuit area in the panel, and thus makes it possible to realize a narrow frame.

4. Fourth Embodiment 4.1 Configuration

Figure 37:
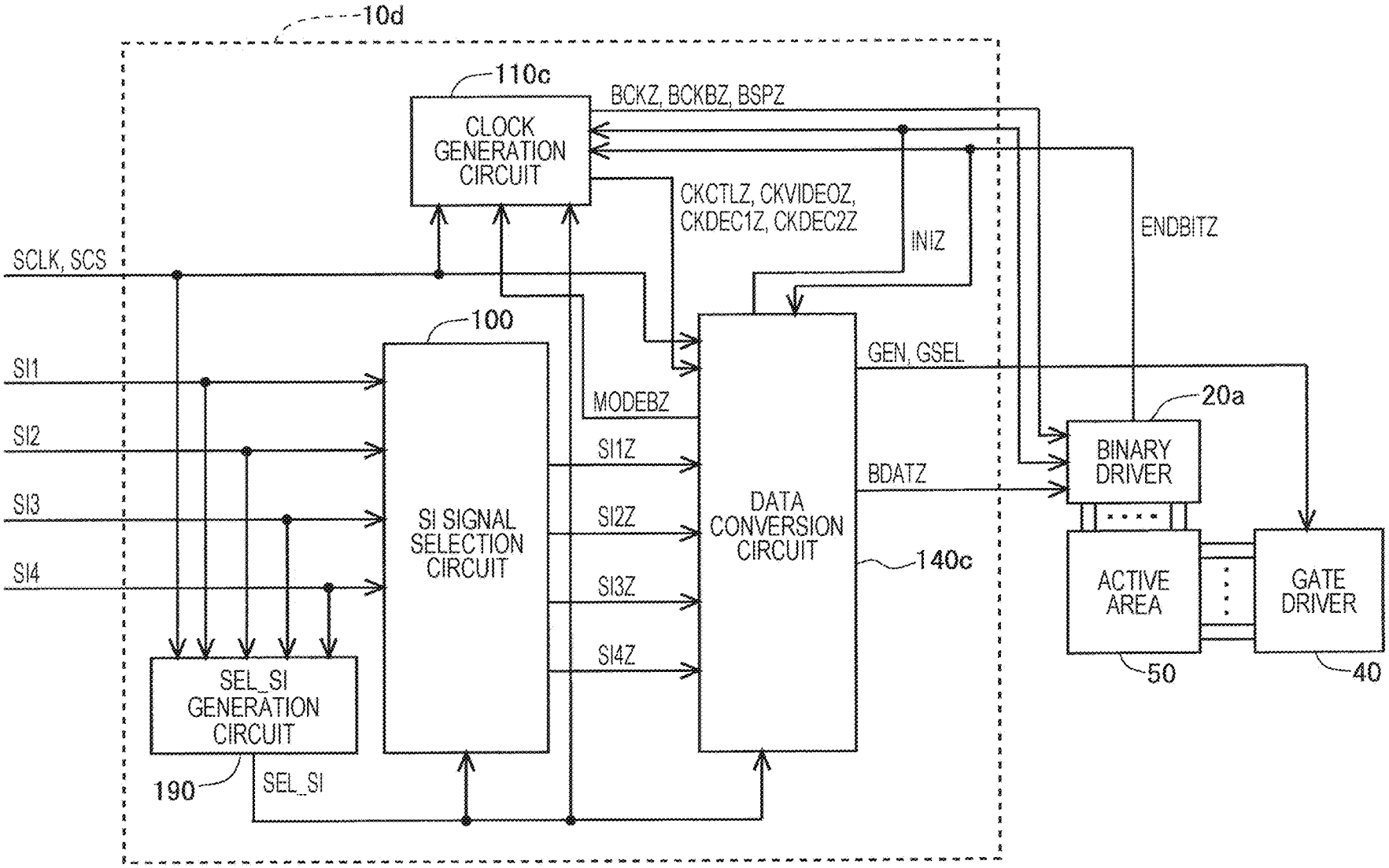
FIG. 37 is a block diagram illustrating an overall configuration of a liquid crystal display device according to a fourth embodiment.

FIG. 37 is a block diagram illustrating an overall configuration of a liquid crystal display device according to a fourth embodiment. In the present embodiment, the timing generator 10*d* is not externally supplied with the serial data selection signal SEL_SI, but the timing generator 10*d* internally includes a SEL_SI generation circuit 190 configured to generating the serial data selection signal SEL_SI. In the example shown in FIG. 37, the SEL_SI generation circuit 190 is added to the configuration according to the third embodiment (see FIG. 33). However, the SEL_SI generation circuit 190 may be added to the configuration according to the first embodiment (see FIG. 2) or the configuration according to the second embodiment (see FIG. 26).

The SEL_SI generation circuit 190 is supplied with serial data SI1 to SI4, a serial clock SCLK, and a serial chip select signal SCS. In the present embodiment, flag data used in generating the serial data selection signal SEL_SI is included in the serial data SI1 to SI4. The SEL_SI generation circuit 190 generates the serial data selection signal SEL_SI according to the flag data. According to this serial data selection signal SEL_SI, the SI signal selection circuit 100 and the data conversion circuit 140*c* operate.

4.2 Effects

The present embodiment provides an effect, in addition to the same effects as those obtained in the third embodiment, that it becomes possible to select (switch) whether one serial data line is used or four serial data lines are used without externally supplying the serial data selection signal SEL_SI to the liquid crystal display device.

5. Others

In each of the above-described embodiments, it is possible to select (switch) whether to use one serial data line or four (plural) serial data lines. However, the present disclosure is not limited to this configuration. For example, a plurality of serial data lines may be fixedly used. In this case, the SI signal selection circuit 100 may not be used.

In each of the above embodiments, by way of example, one serial data selection signal SEL_SI is used. However, a plurality of serial data selection signals SEL_SI may be used. For example, two serial data selection signals SEL_SI may be used to select, among one, two, and four, the number of serial data lines to be used.

Although the present disclosure has been described in detail above, the above description is illustrative in all aspects and not restrictive. It is to be understood that numerous other modifications and variations can be devised without departing from the scope of the disclosure.

The present disclosure contains subject matter related to that disclosed in U.S. Provisional Patent Application No. 62/884,687 filed in the United States Patent Office on Aug. 9, 2019, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid crystal display device comprising a plurality of pixel circuits each including a memory circuit, comprising:

an interface circuit configured to receive a plurality of pieces of serial data corresponding to image data and a serial clock signal from an outside;

a serial data selection circuit configured to switch processing target data to be captured between one piece of serial data included in the plurality of pieces of serial data and the plurality of pieces of serial data in accordance with a serial data selection signal;

a serial data conversion circuit configured to perform a serial-parallel conversion process for converting the processing target data captured by the serial data selection circuit into parallel data; and a display drive circuit configured to update data in the memory circuit disposed in each of the plurality of pixel circuits according to the parallel data obtained via the serial-parallel conversion process; wherein the serial data conversion circuit is capable of performing the serial-parallel conversion process on the plurality of pieces of serial data in parallel in accordance with one clock pulse of the serial clock signal;

the serial data conversion circuit includes a plurality of data conversion circuits for performing the serial-parallel conversion processes on the plurality of pieces of serial data such that the plurality of pieces of serial data correspond, in a one-to-one manner, to the serial data conversion circuits; and the display drive circuit includes:

a first data drive circuit configured to capture parallel data output from one of the plurality of data conversion circuits corresponding to one piece of serial data included in the plurality of pieces serial data, a first output control circuit configured to control whether the data signal output from the first data drive circuit is to be supplied to the memory circuit according to the serial data selection signal, a second data drive circuit configured to capture parallel data output from the plurality of data conversion circuits and output a data signal for updating data stored in the memory circuit, and a second output control circuit configured to control whether the data signal output from the second data drive circuit is to be supplied to the memory circuit according to the serial data selection signal.

2. The liquid crystal display device according to claim 1, wherein the interface circuit receives the serial data selection signal from an outside.

3. The liquid crystal display device according to claim 1, further comprising a serial data selection signal generation circuit configured to generate the serial data selection signal, wherein the serial data includes flag data for use in generating the serial data selection signal, and the serial data selection signal generation circuit generates the serial data selection signal according to the flag data.

4. A liquid crystal display device comprising a plurality of pixel circuits each including a memory circuit, comprising:

an interface circuit configured to receive a plurality of pieces of serial data corresponding to image data and a serial clock signal from an outside;

a serial data selection circuit configured to switch processing target data to be captured between one piece of serial data included in the plurality of pieces of serial data and the plurality of pieces of serial data in accordance with a serial data selection signal;

a serial data conversion circuit configured to perform a serial-parallel conversion process for converting the processing target data captured by the serial data selection circuit into parallel data;

a display drive circuit configured to update data in the memory circuit disposed in each of the plurality of pixel circuits according to the parallel data obtained via the serial-parallel conversion process; and a supply switching circuit for switching parallel data supplied to the display drive circuit; wherein the serial data conversion circuit is capable of performing the serial-parallel conversion process on the plurality of pieces of serial data in parallel in accordance with one clock pulse of the serial clock signal;

the serial data conversion circuit includes:

a first data conversion circuit configured to perform the serial-parallel conversion process on the one piece of serial data, and a second data conversion circuit configured to perform the serial-parallel conversion process on the plurality of pieces of serial data, and the supply switching circuit switches parallel data to be supplied to the display drive circuit according to the serial data selection signal between parallel data output from the first data conversion circuit and parallel data output from the second data conversion circuit.

5. The liquid crystal display device according to claim 4, further comprising a first clock signal generation circuit for generating a timing control clock signal group in a case where processing target data captured by the serial data selection circuit is the one piece of serial data, and a second clock signal generation circuit for generating a timing control clock signal group in a case where processing target data captured by the serial data selection circuit is the plurality of piece of serial data, wherein the supply switching circuit switches the timing control clock signal group supplied to the display drive circuit according to the serial data selection signal between the timing control clock signal group generated by the first clock signal generation circuit and the timing control clock signal group generated by the second clock signal generation circuit, and the display drive circuit updates the data in the memory circuits included the plurality of pixel circuits according to the timing control clock signal group supplied, via the supply switching circuit, from the first clock signal generation circuit or the second clock signal generation circuit, the plurality of pieces of serial data are n pieces of serial data where n is an integer equal to or larger than 2, and the frequency of the timing control clock signal group generated by the second clock signal generation circuit is n times the frequency of the timing control clock signal group generated by the first clock signal generation circuit.

6. The liquid crystal display device according to claim 4, wherein the interface circuit receives the serial data selection signal from an outside.

7. The liquid crystal display device according to claim 4, further comprising a serial data selection signal generation circuit configured to generate the serial data selection signal, wherein the serial data includes flag data for use in generating the serial data selection signal, and the serial data selection signal generation circuit generates the serial data selection signal according to the flag data.

8. A liquid crystal display device comprising a plurality of pixel circuits each including a memory circuit, comprising:

an interface circuit configured to receive a plurality of pieces of serial data corresponding to image data and a serial clock signal from an outside, a serial data selection circuit configured to switch processing target data to be captured between one piece of serial data included in the plurality of pieces of serial data and the plurality of pieces of serial data in accordance with a serial data selection signal;

a serial data conversion circuit configured to perform a serial-parallel conversion process for converting the processing target data captured by the serial data selection circuit into parallel data;

a display drive circuit configured to update data in the memory circuit disposed in each of the plurality of pixel circuits according to the parallel data obtained via the serial-parallel conversion process; and a clock signal group generation circuit configured to, in accordance with the serial data selection signal, generate a timing control clock signal group for use in a case where processing target data captured by the serial data selection circuit is the one piece of serial data or a timing control clock signal group for use in a case where processing target data captured by the serial data selection circuit is the plurality of pieces of serial data; wherein the serial data conversion circuit is capable of performing the serial-parallel conversion process on the plurality of pieces of serial data in parallel in accordance with one clock pulse of the serial clock signal;

the serial data conversion circuit performs the serial-parallel conversion process on the one piece of serial data or the plurality of pieces of serial data according to the serial data selection signal, the display drive circuit updates data in the memory circuits included in the plurality of pixel circuits according to the timing control clock signal group generated by the clock signal group generation circuit, the plurality of pieces of serial data are n pieces of serial data where n is an integer equal to or larger than 2, and the frequency of the timing control clock signal group for use in the case where the processing target data captured by the serial data selection circuit is the plurality of pieces of serial data is n times the frequency of the timing control clock signal group for use in the case where the processing target data captured by the serial data selection circuit is the one piece of serial data.

9. The liquid crystal display device according to claim 8, wherein the interface circuit receives the serial data selection signal from an outside.

10. The liquid crystal display device according to claim 8, further comprising a serial data selection signal generation circuit configured to generate the serial data selection signal, wherein the serial data includes flag data for use in generating the serial data selection signal, and the serial data selection signal generation circuit generates the serial data selection signal according to the flag data.

* * * * *